US008320804B2

(12) United States Patent
Udaka et al.

(10) Patent No.: US 8,320,804 B2
(45) Date of Patent: Nov. 27, 2012

(54) IMAGE FORMING APPARATUS, CONTROL APPARATUS, COMPUTER READABLE MEDIUM AND CONTROL METHOD TO MITIGATE COLOR SHIFT

(75) Inventors: Tsutomu Udaka, Ebina (JP); Kozo Tagawa, Ebina (JP); Naoto Nishi, Ebina (JP); Yoshiki Matsuzaki, Ebina (JP); Shun Yashima, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 461 days.

(21) Appl. No.: 12/273,162

(22) Filed: Nov. 18, 2008

(65) Prior Publication Data

US 2009/0324305 A1 Dec. 31, 2009

(30) Foreign Application Priority Data

Jun. 27, 2008 (JP) ..... 2008-169323

(51) Int. Cl.
*G03G 15/00* (2006.01)
*G03G 15/01* (2006.01)
*G03G 15/10* (2006.01)

(52) U.S. Cl. ..... 399/302; 399/66; 399/167; 399/301; 399/388; 399/396

(58) Field of Classification Search ..... 399/302
See application file for complete search history.

(56) References Cited

U.S. PATENT DOCUMENTS

| | | | | |
|---|---|---|---|---|
| 2004/0165915 | A1* | 8/2004 | Hirai et al. | 399/302 |
| 2006/0165442 | A1* | 7/2006 | Kobayashi et al. | 399/301 |
| 2007/0134022 | A1* | 6/2007 | Freudenberg et al. | 399/167 |
| 2008/0175612 | A1* | 7/2008 | Oikawa et al. | 399/66 |

FOREIGN PATENT DOCUMENTS

| | | |
|---|---|---|
| JP | 05-027514 | 2/1993 |
| JP | 2003-084643 | 3/2003 |
| JP | 2004-151383 | 5/2004 |
| JP | 2005-107118 | 4/2005 |
| JP | 2006-259208 | 9/2006 |

OTHER PUBLICATIONS

Notification of Reasons for Refusal for Patent Application No. 2008-169323 dated Sep. 28, 2010.*

* cited by examiner

*Primary Examiner* — Walter L Lindsay, Jr.
*Assistant Examiner* — David Bolduc
(74) *Attorney, Agent, or Firm* — Morgan, Lewis & Bockius LLP

(57) ABSTRACT

The image forming apparatus is provided with: a toner image carrying member that moves while carrying a toner image; a transferring member that transfers, on a recording medium, the toner image that the toner image carrying member carries; a transporting unit that transports the recording medium along a transport path that passes through a transfer region where the transferring member transfers the toner image onto the recording medium; and a controller that controls a movement speed of the toner image carrying member. The controller changes the movement speed of the toner image carrying member in accordance with a position, on the transport path, of the recording medium that the transporting unit transports.

13 Claims, 13 Drawing Sheets

MOVEMENT SPEED (Vb) OF INTERMEDIATE TRANSFER BELT AND CIRCUMFERENTIAL SPEED ($V_m$) OF DRIVE ROLL

MOVEMENT SPEED (Vb) OF INTERMEDIATE TRANSFER BELT AND CIRCUMFERENTIAL SPEED (Vm) OF DRIVE ROLL

MOVEMENT SPEED (Vb) OF INTERMEDIATE TRANSFER BELT AND CIRCUMFERENTIAL SPEED ($V_m$) OF DRIVE ROLL

IMAGE FORMING APPARATUS, CONTROL APPARATUS, COMPUTER READABLE MEDIUM AND CONTROL METHOD TO MITIGATE COLOR SHIFT

CROSS REFERENCE TO RELATED APPLICATIONS

This application is based on and claims priority under 35 USC §119 from Japanese Patent Application No. 2008-169323 filed Jun. 27, 2008.

BACKGROUND

1. Technical Field

The present invention relates to an image forming apparatus, a control apparatus, a computer readable medium storing a program and a control method.

2. Related Art

Generally, in a color image forming apparatus such as a color copy machine or a color printer, an image is formed on a paper sheet through the processes of: sequentially forming and superposing color toner images on, for example, an intermediate transfer member; and collectively transferring the color toner images from the intermediate transfer member onto the paper sheet. In this event, the color image forming apparatus sometimes performs the process of collectively transferring color toner images on a paper sheet concurrently with the process of forming, on the intermediate transfer member, the toner images for the paper sheet or toner images for an adjacent paper sheet to the paper sheet. In addition, the color image forming apparatus sometimes performs the process of collectively transferring color toner images on a paper sheet concurrently with a fixing process.

Meanwhile, to prevent a collective transfer unit and any of paper-sheet transporting members placed around the collective transfer unit from pulling a paper sheet in opposite directions, a paper-sheet transport speed of each of these paper-sheet transporting members is generally set such that the paper-sheet transporting member located more upstream has a higher paper-sheet transport speed. For example, a paper-sheet transport speed of transport rolls located upstream to the collective transfer unit is set higher than a speed of the intermediate transfer member. In addition, a paper-sheet transport speed of a fixing device located downstream to the collective transfer unit is set lower than the speed of the intermediate transfer member. As a result, when a paper sheet transported by the transport rolls enters the collective transfer unit, the paper sheet applies an additional force in its transport direction on the intermediate transfer member, and thus a load on the intermediate transfer member changes. Similarly, when a paper sheet enters the fixing unit located downstream to the collective transfer unit, the load on the intermediate transfer member changes. Hence, when a paper sheet enters the collective transfer unit or the fixing unit, the transport speed of the intermediate transfer member is likely to change, and this change affects toner image formation on the intermediate transfer member.

Accordingly, around the times such as when the collective transfer starts and when a paper sheet enters the fixing unit, color toner images might be displaced on the intermediate transfer member, resulting in a color shift or the like in the obtained image.

SUMMARY

According to an aspect of the present invention, there is provided an image forming apparatus including: a toner image carrying member that moves while carrying a toner image; a transferring member that transfers, on a recording medium, the toner image that the toner image carrying member carries; a transporting unit that transports the recording medium along a transport path that passes through a transfer region where the transferring member transfers the toner image onto the recording medium; and a controller that controls a movement speed of the toner image carrying member. The controller changes the movement speed of the toner image carrying member in accordance with a position, on the transport path, of the recording medium that the transporting unit transports.

BRIEF DESCRIPTION OF THE DRAWINGS

Exemplary embodiment(s) of the present invention will be described in detail based on the following figures, wherein.

DETAILED DESCRIPTION

Hereinafter, a description will be given of exemplary embodiments of the present invention in detail with reference to the attached drawings.

Figure 1:
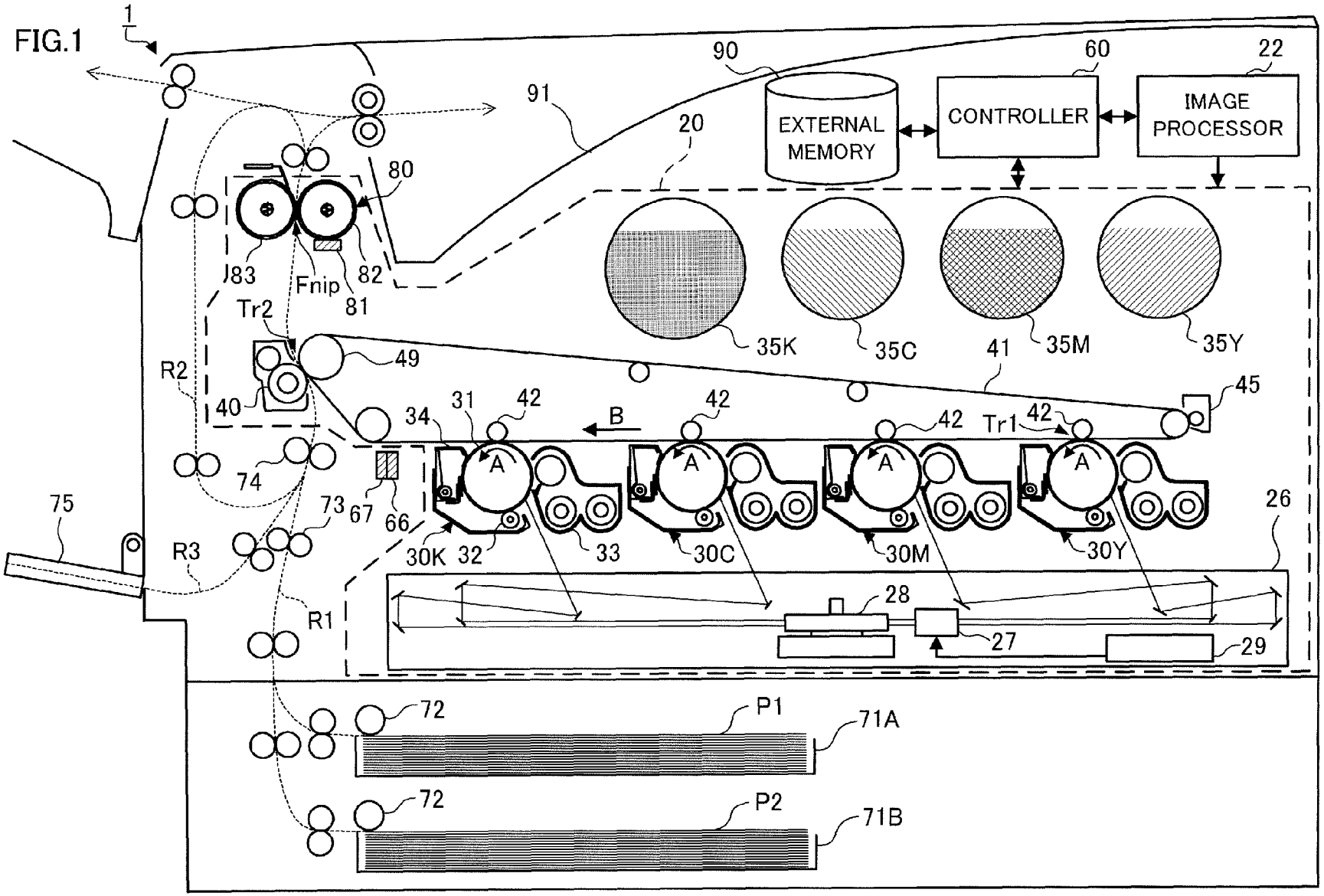
FIG. 1 is a view showing an example of a configuration of an image forming apparatus to which an exemplary embodiment is applied.

FIG. 1 is a view showing an example of a configuration of an image forming apparatus 1 to which an exemplary embodiment is applied. The image forming apparatus 1 shown in FIG. 1 is a digital color printer with a so-called tandem type, and is provided with an image forming processor 20 that forms a color image on the basis of image data, a controller 60 that controls operation of the entire image forming apparatus 1, an image processor 22 that performs an image processing set in advance on image data received from an image generating device such as a personal computer (PC), an image capturing device such as a scanner, or the like, and an external memory 90 that is realized by, for example, a hard disk drive (HDD) in which a processing program and the like are recorded.

Moreover, the image forming apparatus 1 is provided with a humidity sensor 66 that detects humidity in the image forming apparatus 1, and a temperature sensor 67 that detects temperature in the image forming apparatus 1.

The image forming processor 20 is provided with four image forming units 30Y, 30M, 30C and 30K (hereinafter, also collectively referred to as "image forming units 30") that are arranged in parallel at certain intervals, and that form yellow (Y), magenta (M), cyan (C) and black (K) toner images, respectively. Note that image forming units that form, for example, light cyan (LC), light magenta (LM), clear, corporate color toner images may be provided in addition to the above-described configuration so that five or more color image forming units are provided.

The image forming unit 30 is provided with a photoconductor drum 31 that rotates in an arrow A direction and on which an electrostatic latent image is formed, a charging roll 32 that uniformly charges a surface of the photoconductor drum 31 at a given potential, a developing device 33 that develops the electrostatic latent image formed on the photoconductor drum 31, and a cleaning unit 34 that cleans the surface of the photoconductor drum 31 after primary transfer. The developing device 33 arranged in each image forming unit 30 develops the electrostatic latent image on the photoconductor drum 31 with each of Y, M, C or K toners supplied by corresponding one of toner containers 35Y, 35M, 35C and 35K.

Further, the image forming processor 20 is provided with a laser exposing device 26 (that may use LEDs, a light-emitting element array such as an organic EL, or the like) that exposes each photoconductor drum 31 provided in each image forming unit 30, an intermediate transfer belt 41 as an example of a toner image carrying member that carries and transports color toner images that have been formed on the respective photoconductor drums 31 of the image forming units 30 and then that have been multi-transferred, primary transfer rolls 42 that sequentially transfer (primarily transfer) color toner images of the image forming units 30 onto the intermediate transfer belt 41 at respective primary transfer portions Tr1, a secondary transfer roll 40 as an example of a transferring member that collectively transfers (secondarily transfers) superimposed toner images transferred onto the intermediate transfer belt 41 onto a paper sheet P (P1, P2) as a recording medium (recording paper) at a secondary transfer portion Tr2, and a fixing device 80 that fixes the secondarily transferred image onto the paper sheet P.

The laser exposing device 26 is provided with a semiconductor laser 27 as a light source, a scanning optical system (not shown in the figure) that scans and exposes the photoconductor drum 31 to laser light, a rotating polygon mirror (polygon mirror) 28 that is formed in, for example, a regular hexahedron, and a laser driver 29 that controls driving of the semiconductor laser 27. The laser driver 29 obtains image data from the image processor 22, light amount control signal from the controller 60, and the like, and controls lighting of the semiconductor laser 27 and output light amount, and the like.

The primary transfer roll 42 receives primary transfer bias voltage supplied from a primary transfer power supply (not shown in the figure), and primarily transfers each color toner image onto the intermediate transfer belt 41. Further, the secondary transfer roll 40 receives secondary transfer bias voltage supplied from a secondary transfer power supply (not shown in the figure), and secondarily transfers the color toner images onto the paper sheet P.

The fixing device 80 is provided with a fixing roll 82 that has a heat source therein, and a pressure roll 83 that is arranged so as to be in contact with the fixing roll 82 with pressure. Then, the paper sheet P holding the unfixed toner image is caused to pass through a nip portion "Fnip" formed between the fixing roll 82 and the pressure roll 83 so that the toner image is fixed on the paper sheet P.

In the above-described image forming apparatus 1, the image processor 22 performs image processing set in advance on the image data inputted from a PC, a scanner or the like, and the resultant data are transmitted to the laser exposing device 26 of the image forming processor 20. Further, the photoconductor drum 31 is uniformly charged by the charging roll 32. Then, the laser exposing device 26 scans and exposes the photoconductor drum 31 uniformly charged in each image forming unit 30 to laser light controlled on the basis of the image data from the image processor 22. Thereby, an electrostatic latent color image is formed on each photoconductor drum 31. The formed electrostatic latent image is developed by each developing device 33, and each color toner image is formed on each photoconductor drum 31.

The each color toner image formed in each image forming unit 30 is primarily transferred, in sequence, by each of the primary transfer rolls 42, onto the intermediate transfer belt 41 circularly rotating in an arrow B direction of FIG. 1 by a drive roll 49. Here, the primary transfer bias voltage set in advance is applied to the primary transfer roll 42. Thereby, on the intermediate transfer belt 41, the superimposed toner images that are formed by superimposing the color toner images with each other are formed. According to the movement of the intermediate transfer belt 41, the superimposed toner images are transported toward the secondary transfer portion Tr2 where the secondary transfer roll 40 and the drive roll 49 are arranged.

On the other hand, in the image forming apparatus 1, plural paper sheet holding units 71A and 71B are arranged, for example. On the basis of instruction input by a user using, for example, an operation input unit (not shown in the figure), a paper sheet P1 held in the paper sheet holding unit 71A is taken out by a pickup roll 72, for example. The paper sheet P1 that has been taken out is transported along a transport path R1, one by one, and then is transported at a position where registration rolls 74 are arranged, by pre-registration transport rolls 73.

The registration rolls 74 are an example of a first transporting member, and supplies paper sheet P1 to the secondary transfer portion Tr2 at a right timing when the superimposed toner image on the intermediate transfer belt 41 is transported to the secondary transfer portion Tr2. Then, by the action of the transfer electric field formed between the secondary transfer roll 40 to which the secondary transfer bias voltage set in advance is applied and the drive roll 49, the superimposed toner images are collectively and secondarily transferred onto the paper sheet P1.

Note that the paper sheet P is transported toward the secondary transfer portion Tr2 via a duplex transport path R2 that is used at a duplex printing for the paper sheet P, or a transport path R3 from a paper sheet holding unit 75 for manual feeding used at manually feeding a paper sheet P, in addition to the transport path R1 where the paper sheet P1 and P2 that are held in the paper sheet holding units 71A and 71B, respectively, are transported.

Subsequently, the paper sheet P1 on which the color toner images are electrostatically transferred at the secondary transfer portion Tr2 is peeled from the intermediate transfer belt 41, and is transported toward the fixing device 80. In the fixing device 80, the paper sheet P1 passes through the nip portion Fnip of the fixing device 80, and thus the color toner images are fixed onto the paper sheet P1. Then the paper sheet P1 on which the fixed image has been formed is transported to a paper sheet stacking unit 91 that is provided at an exit portion of the image forming apparatus 1. On the other hand, toner (transfer remaining toner) attached on the intermediate transfer belt 41 after the secondary transfer is removed by a belt cleaner 45 arranged so as to be in contact with the intermediate transfer belt 41, and the next image forming cycle is prepared.

As described above, image formation in the image forming apparatus 1 is performed by repeating the image formation for the instructed number of the paper sheets.

Next, a description will be given of transport mechanisms for a paper sheet P from the pre-registration transport rolls 73 and the registration rolls 74 to the fixing device 80 through the secondary transfer portion Tr2, in the image forming apparatus 1 of the present exemplary embodiment.

Figure 2:
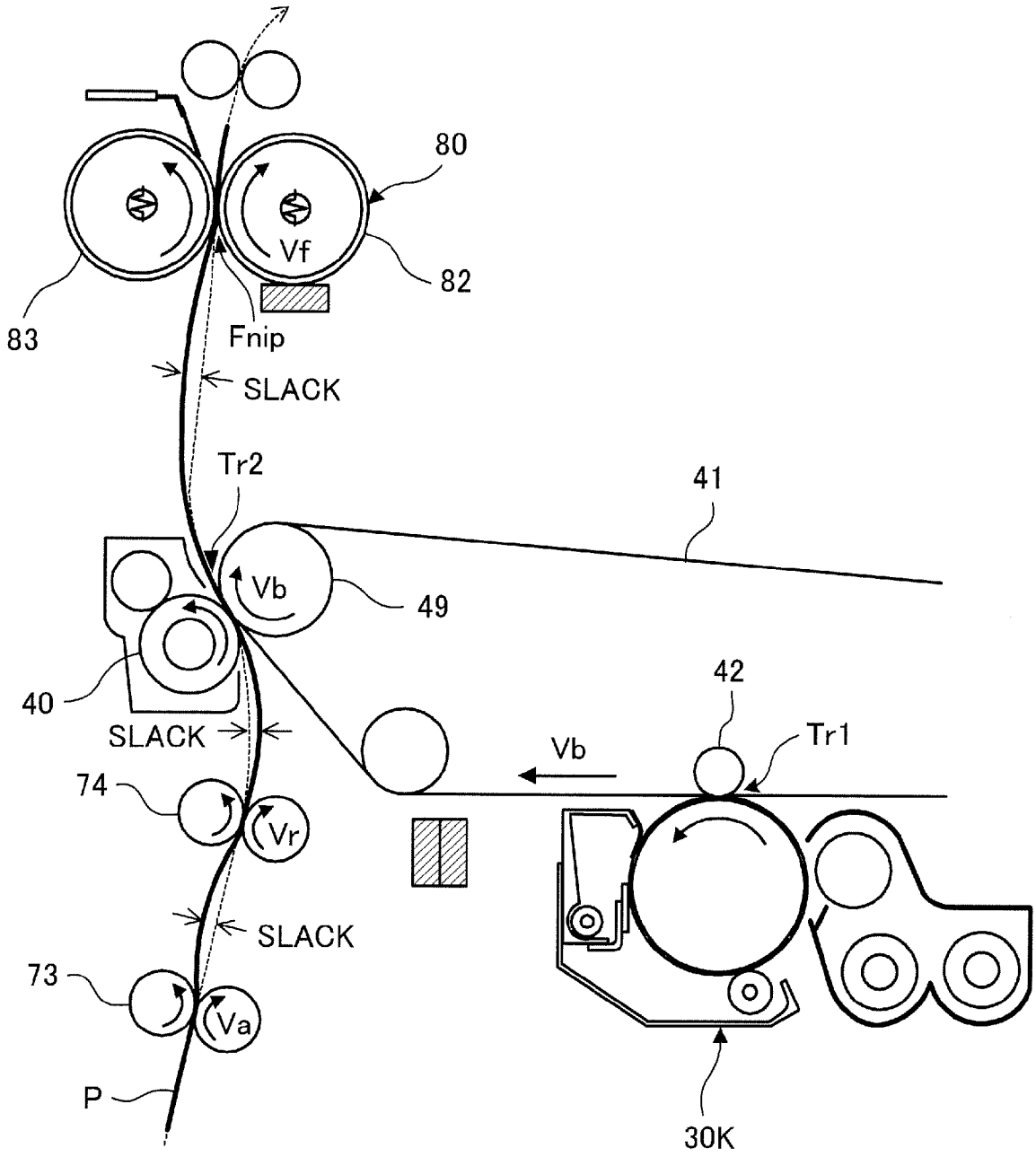
FIG. 2 shows the transport mechanisms for a paper sheet from the pre-registration transport rolls to the fixing device.

FIG. 2 shows the transport mechanisms for a paper sheet P from the pre-registration transport rolls 73 to the fixing device 80. As shown in FIG. 2, a drive mechanism (not shown in the figure) causes the pre-registration transport rolls 73 to transport the paper sheet P to the registration rolls 74 at a transport speed Va. Then, the drive mechanism (not shown in the figure) causes the registration rolls 74 to transport the paper sheet P to the secondary transfer portion Tr2 at a transport speed Vr at the right timing when superimposed toner images are transported to the secondary transfer portion Tr2. On the other hand, a circumferential speed of the drive roll 49, which drives the intermediate transfer belt 41, is set to a predetermined design value Vb, and thereby the drive roll 49 circulatingly moves the intermediate transfer belt 41 at a movement speed Vb. Meanwhile, in the fixing device 80, which is an example of a second transporting member, each of the fixing roll 82 and the pressure roll 83 rotates at a circumferential speed Vf.

In the upstream side to the secondary transfer portion Tr2, the transport speed Va at which the pre-registration transport rolls 73 transport the paper sheet P, the transport speed Vr at which the registration rolls 74 transport the paper sheet P, and the movement speed Vb at which the drive roll 49 moves the intermediate transfer belt 41 are set to satisfy the relation of $Va \geqq Vr \geqq Vb$.

To be more precise, in the secondary transfer portion Tr2 where the superimposed toner images are transferred, the transport speed of the paper sheet P at the secondary transfer portion Tr2 should ideally be equal to the movement speed Vb of the intermediate transfer belt 41 for the following reason. If the transport speed of the paper sheet P is equal to the movement speed Vb of the intermediate transfer belt 41, the whole superimposed toner images held on the intermediate transfer belt 41 are transferred on the paper sheet P at a one-to-one magnification. Accordingly, no magnification deviation occurs in the superimposed toner images in the transport direction of the paper sheet P.

However, actually in the image forming apparatus 1, the intermediate transfer belt 41, the components for configuring each transport mechanism for a paper sheet P, and the like may have manufacturing dimensional errors and/or assembly errors, while drive motors to operate the above members may have rotation irregularities and like. Thus, it is difficult to make the transport speed of the paper sheet P accurately and exactly equal to the movement speed Vb of the intermediate transfer belt 41. For this reason, typically, the relation among Va, Vr and Vb are set under the assumption that the transport speed of the paper sheet P is not exactly equal to the movement speed Vb of the intermediate transfer belt 41. Specifically, Vr and Vb are set to satisfy $Vr \geqq Vb$, and thereby the image forming apparatus 1 is configured such that a paper sheet P is slacked in the upstream side to the secondary transfer portion Tr2. This reduces, at the secondary transfer portion Tr2, the effect of driving forces of the transport mechanisms located upstream to the secondary transfer portion Tr2, such as the registration rolls 74, and thus helps the paper sheet P move along with the movement of the intermediate transfer belt 41. Similarly, between the pre-registration transport rolls 73 and the registration rolls 74, Va and Vr are set to satisfy $Va \geqq Vr$, and thereby the image forming apparatus 1 is configured such that the paper sheet P is slacked between the pre-registration transport rolls 73 and the registration rolls 74.

Meanwhile, in the downstream side to the secondary transfer portion Tr2, the movement speed Vb of the intermediate transfer belt 41 and the circumferential speed Vf of the fixing device 80 are set to satisfy the relation of $Vb \geqq Vf$, for a similar reason to the above. Accordingly, the paper sheet P is slacked between the secondary transfer portion Tr2 and the fixing device 80. This reduces, in the secondary transfer portion Tr2, the effect of a driving force of the fixing device 80, which is located downstream to the secondary transfer portion Tr2, and thus helps the paper sheet P move along with the movement of the intermediate transfer belt 41.

For the foregoing reasons, the secondary transfer portion Tr2 and the transport mechanisms on a transport path of the paper sheet P upstream and downstream to the secondary transfer portion Tr2 are configured such that the transport speed of the paper sheet P are set to satisfy the relation of $Va \geqq Vr \geqq Vb \geqq Vf$.

Causing the transport mechanisms to operate at different speeds to satisfy $Va \geqq Vr \geqq Vb \geqq Vf$ as described above helps the paper sheet P be transported along with the movement of the intermediate transfer belt 41 at the secondary transfer portion Tr2. Thus, the superimposed toner images held on the intermediate transfer belt 41 are transferred onto the paper sheet P with diminished displacement. However, the fact that the transport mechanisms provided at the secondary transfer portion Tr2 and provided upstream and downstream to the secondary transfer portion Tr2 are set to operate at different speeds also affects the movement speed Vb of the intermediate transfer belt 41 itself.

For example, the paper sheet P exiting from the registration rolls 74 is transported by the registration rolls 74 at the transport speed Vr, which is higher than the movement speed Vb of the intermediate transfer belt 41. Thus, while passing through the secondary transfer portion Tr2, the paper sheet P applies a push-in force (acceleration force) on the intermediate transfer belt 41 by being in contact with the intermediate transfer belt 41. This accelerates the intermediate transfer belt 41 in the movement direction thereof.

In addition, after, for example, the paper sheet P having passed through the secondary transfer portion Tr2 enters the nip portion Fnip of the fixing device 80, the transport speed of the paper sheet P in the downstream side to the secondary transfer portion Tr2 is reduced by the fixing device 80 rotating at the circumferential speed Vf, which is lower than the movement speed Vb of the intermediate transfer belt 41. Thus, before the paper sheet P gets slacked between the secondary transfer portion Tr2 and the fixing device 80, the decelerated paper sheet P applies a push-back force (brake force) on the intermediate transfer belt 41. This decelerates the intermediate transfer belt 41.

Moreover, after, for example, a trailing end of the paper sheet P passes through the registration rolls 74, the paper sheet P is freed from the transport force of the registration rolls 74 set to operate at the transport speed Vr, which is higher than the movement speed Vb of the intermediate transfer belt 41. Thus, the intermediate transfer belt 41 is decelerated by a brake force applied by the decelerated paper sheet P.

The above changes in the movement speed of the intermediate transfer belt 41 caused by the acceleration and deceleration of the paper sheet P increase in amount in proportion to the frictional force between the paper sheet P and the intermediate transfer belt 41. Especially, for example, in case of a thick paper sheet P or a paper sheet P having a rough surface, which increases the nip pressure at the pressed secondary transfer portion Tr2, the paper sheet P applies increased push-in and brake forces on the intermediate transfer belt 41, and thus makes the changes in the movement speed of the intermediate transfer belt 41 larger.

Then, a description will be given of the changes in the movement speed of the intermediate transfer belt 41 caused by the speed differences among the registration rolls 74, the intermediate transfer belt 41 and the fixing device 80 set to satisfy $Vr \geqq Vb \geqq Vf$.

Figure 3A:
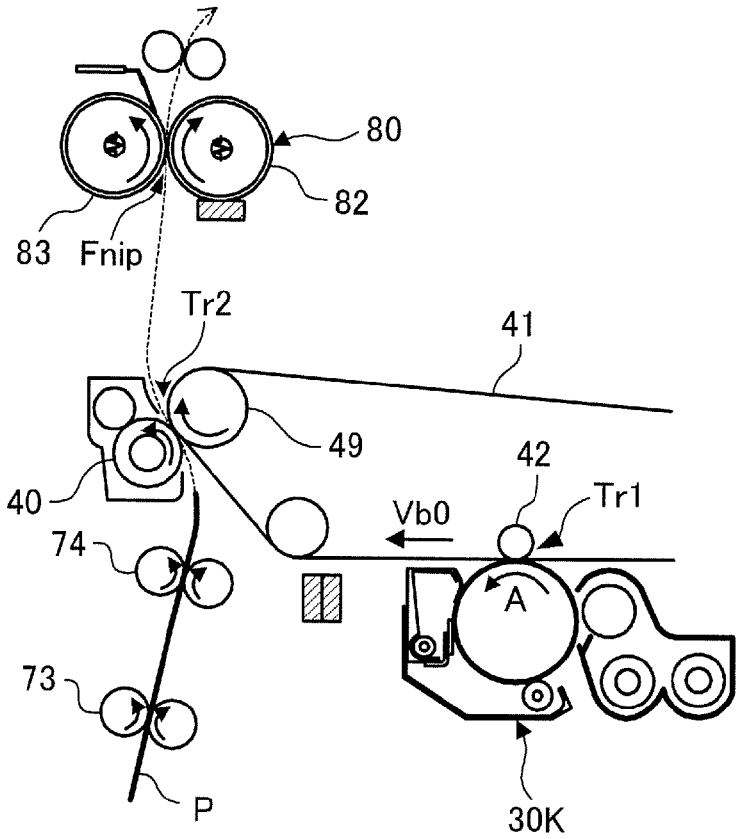
FIG. 3A shows a state before a leading end portion of the paper sheet enters the secondary transfer portion.
Figure 3B:
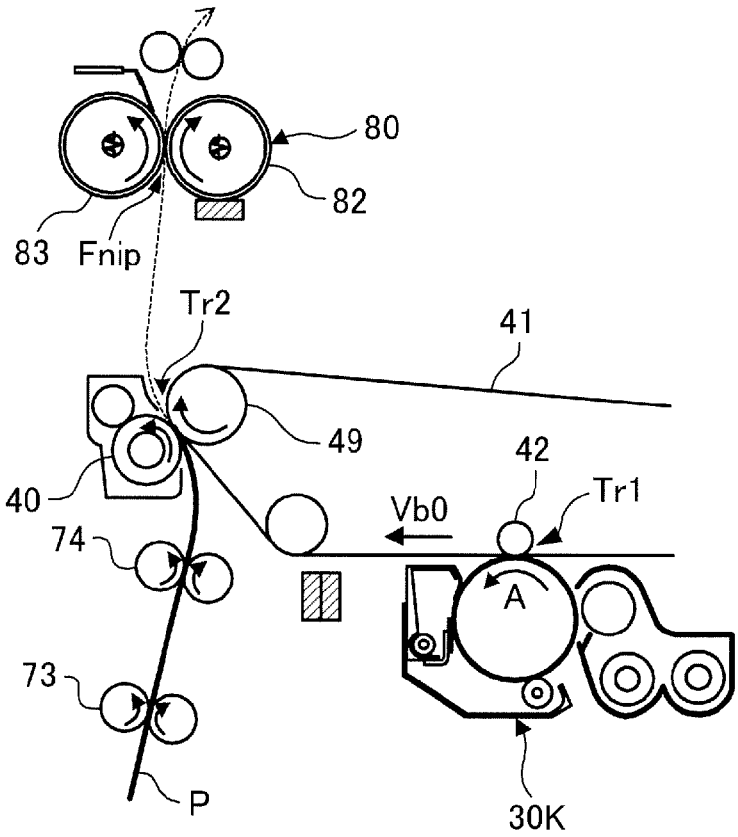
FIG. 3B shows a state where the leading end portion of the paper sheet enters the secondary transfer portion.
Figure 4A:
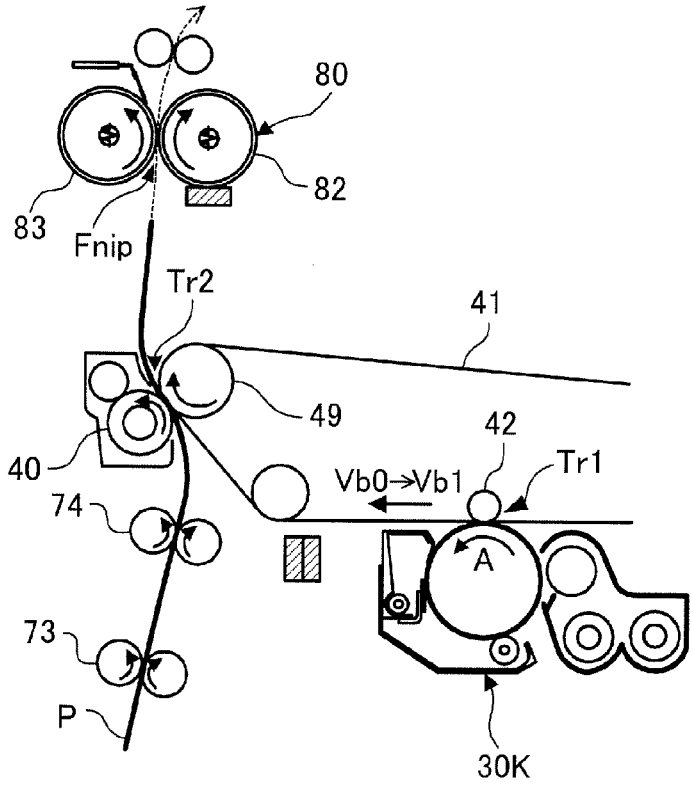
FIG. 4A shows a state where the paper sheet is passing through the secondary transfer portion before the leading end portion of the paper sheet enters the fixing device.
Figure 4B:
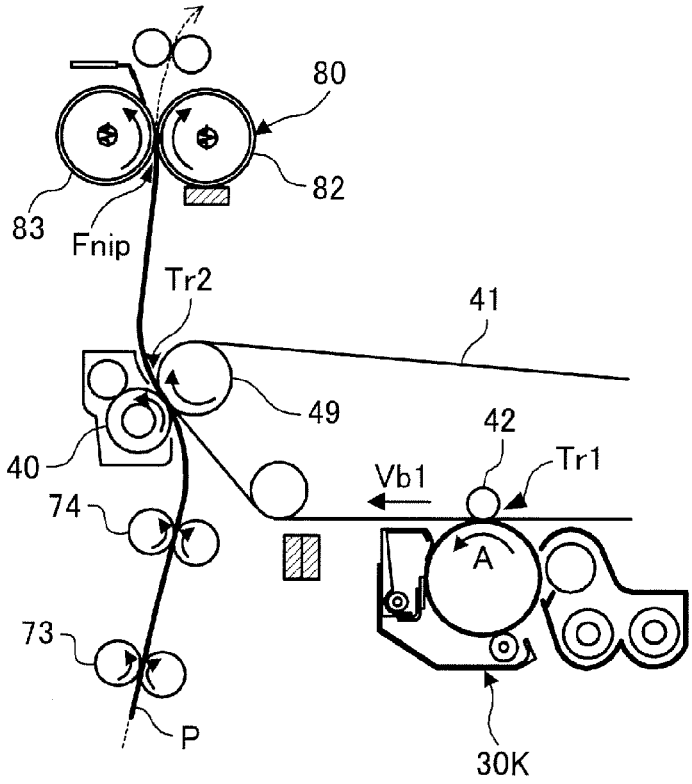
FIG. 4B shows a state where the leading end portion of the paper sheet enters the nip portion of the fixing device.
Figure 5A:
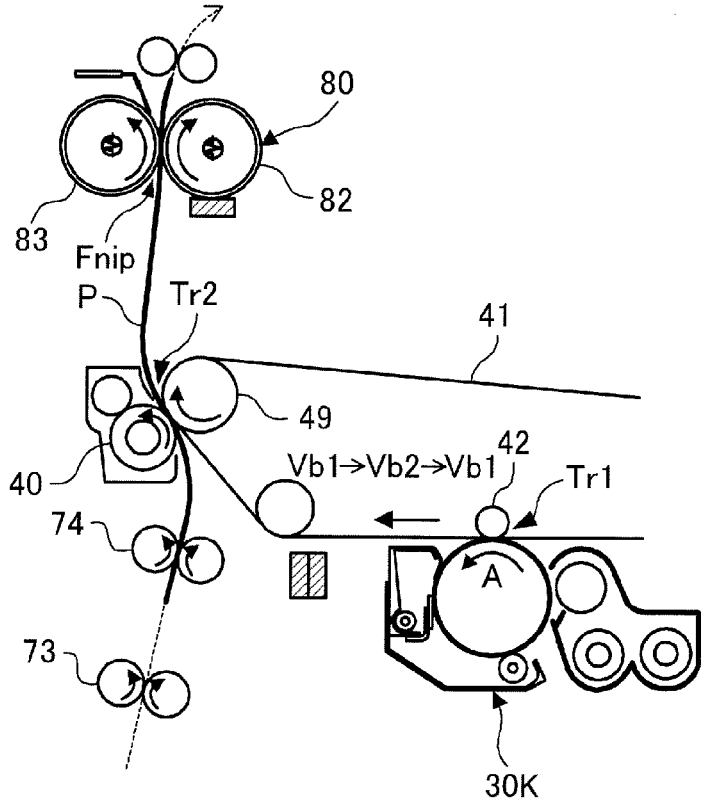
FIG. 5A shows a state where the paper sheet is passing through both the registration rolls and the fixing device.
Figure 5B:
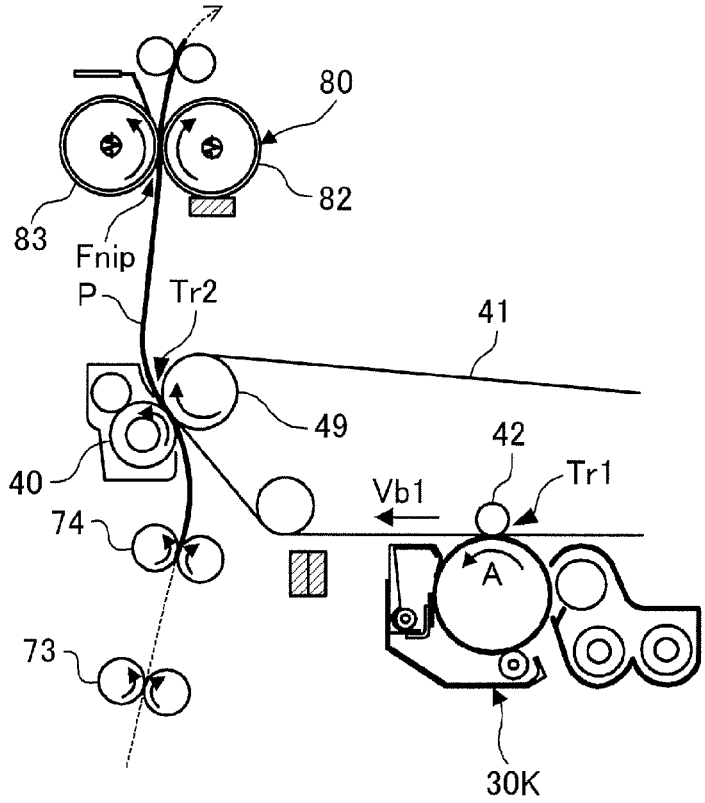
FIG. 5B shows a state where a trailing end portion of the paper sheet has just passed through the registration rolls.
Figure 6A:
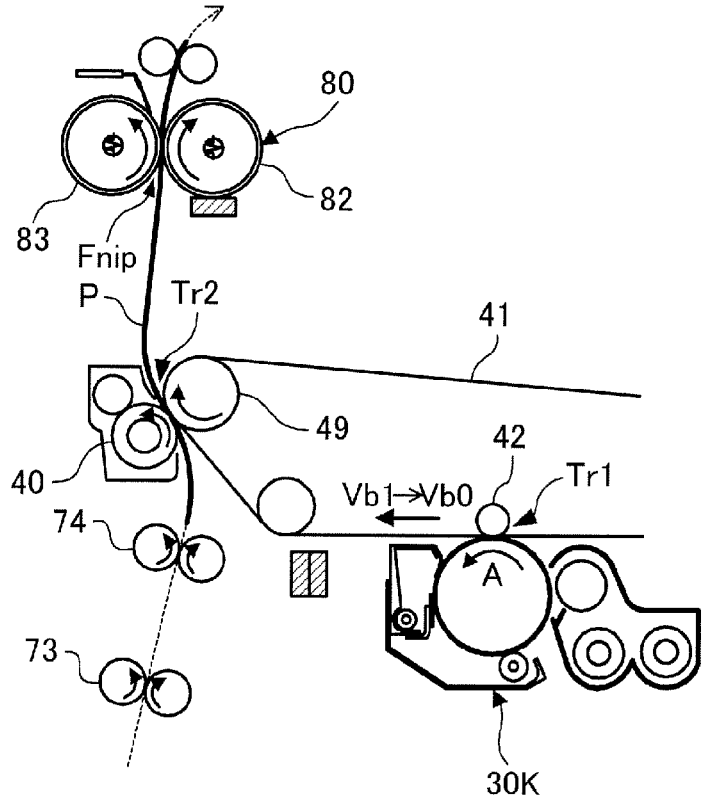
FIG. 6A shows a state after the trailing end portion of the paper sheet passes through the registration rolls.
Figure 6B:
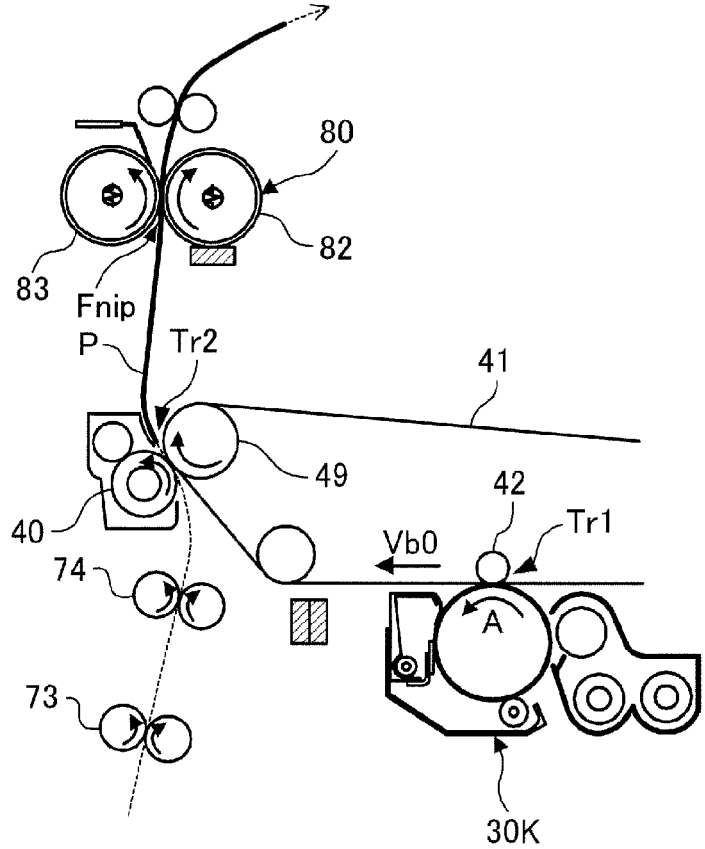
FIG. 6B shows a state after the trailing end portion of the paper sheet passes through the secondary transfer portion.

FIG. 3A shows a state before a leading end portion of the paper sheet P enters the secondary transfer portion Tr2, while FIG. 3B shows a state where the leading end portion of the paper sheet P enters the secondary transfer portion Tr2. FIG. 4A shows a state where the paper sheet P is passing through the secondary transfer portion Tr2 before the leading end portion of the paper sheet P enters the fixing device 80, while FIG. 4B shows a state where the leading end portion of the paper sheet P enters the nip portion Fnip of the fixing device 80. FIG. 5A shows a state where the paper sheet P is passing through both the registration rolls 74 and the fixing device 80, while FIG. 5B shows a state where a trailing end portion of the paper sheet P has just passed through the registration rolls 74. FIG. 6A shows a state after the trailing end portion of the paper sheet P passes through the registration rolls 74, while FIG. 6B shows a state after the trailing end portion of the paper sheet P passes through the secondary transfer portion Tr2.

Firstly, in the state shown in FIG. 3A before the leading end portion of the paper sheet P enters the secondary transfer portion Tr2, the paper sheet P applies no force on the intermediate transfer belt 41. Accordingly, the intermediate transfer belt 41 moves at a movement speed Vb0, which is the design value.

Then, in the state shown in FIG. 3B where the leading end portion of the paper sheet P enters the secondary transfer portion Tr2, the paper sheet P starts applying a push-in force on the intermediate transfer belt 41 by being in contact with the intermediate transfer belt 41 since the paper sheet P is transported at the transport speed Vr ($\geqq$Vb0) at which the registration rolls 74 are set to operate. Thereby, the movement speed Vb of the intermediate transfer belt 41 starts increasing from the design value Vb0.

In the subsequent state shown in FIG. 4A where the paper sheet P is passing through the secondary transfer portion Tr2 before the leading end portion of the paper sheet P enters the fixing device 80, the push-in force applied by the paper sheet P that the registration rolls 74 transport at the transport speed Vr gradually increases the movement speed Vb of the intermediate transfer belt 41 from the design value Vb0 to the movement speed Vb1.

After that, in the state shown in FIG. 4B where the leading end portion of the paper sheet P enters the nip portion Fnip of the fixing device 80, the transport speed of the paper sheet P in the downstream side to the secondary transfer portion Tr2 is reduced to the circumferential speed Vf ($\leqq$Vb0) at which the fixing device 80 is set to rotate. Accordingly, the paper sheet P starts to apply a brake force on the intermediate transfer belt 41. Thereby, the movement speed Vb of the intermediate transfer belt 41 starts decreasing from the movement speed Vb1.

Then, in the state shown in FIG. 5A where the paper sheet P is passing through both the registration rolls 74 and the fixing device 80, the movement speed Vb of the intermediate transfer belt 41 is reduced by the brake force applied by the paper sheet P until the paper sheet P gets slacked between the secondary transfer portion Tr2 and the fixing device 80. Accordingly, the movement speed Vb of the intermediate transfer belt 41 decreases to a movement speed Vb2 ($\leqq$Vb1) before the paper sheet P gets slacked between the secondary transfer portion Tr2 and the fixing device 80. Then, after the paper sheet P gets slacked between the secondary transfer portion Tr2 and the fixing device 80, the brake force that the paper sheet P applies on the intermediate transfer belt 41 decreases. Hence, the push-in force applied by the paper sheet P that the registration rolls 74 transport at the transport speed Vr gradually accelerates the intermediate transfer belt 41 from the movement speed Vb2 again. Then, the movement speed Vb of the intermediate transfer belt 41 reaches the movement speed Vb1.

Thereafter, in the state shown in FIG. 5B where the trailing end portion of the paper sheet P has just passed through the registration rolls 74, the intermediate transfer belt 41 is freed from the push-in force applied by the paper sheet P that the registration rolls 74 transport at the transport speed Vr. Thus, the paper sheet P applies a brake force on the intermediate transfer belt 41, and thereby the movement speed Vb of the intermediate transfer belt 41 starts decreasing from the movement speed Vb1.

In the subsequent state shown in FIG. 6A after the trailing end portion of the paper sheet P passes through the registration rolls 74, the intermediate transfer belt 41 is gradually decelerated from the movement speed Vb1, and the movement speed Vb of the intermediate transfer belt 41 returns to the design value Vb0 at last.

Then, while the movement speed Vb of the intermediate transfer belt 41 is kept at the design value Vb0 again, the trailing end portion of the paper sheet P passes through the secondary transfer portion Tr2 as shown in FIG. 6B.

Figure 7:
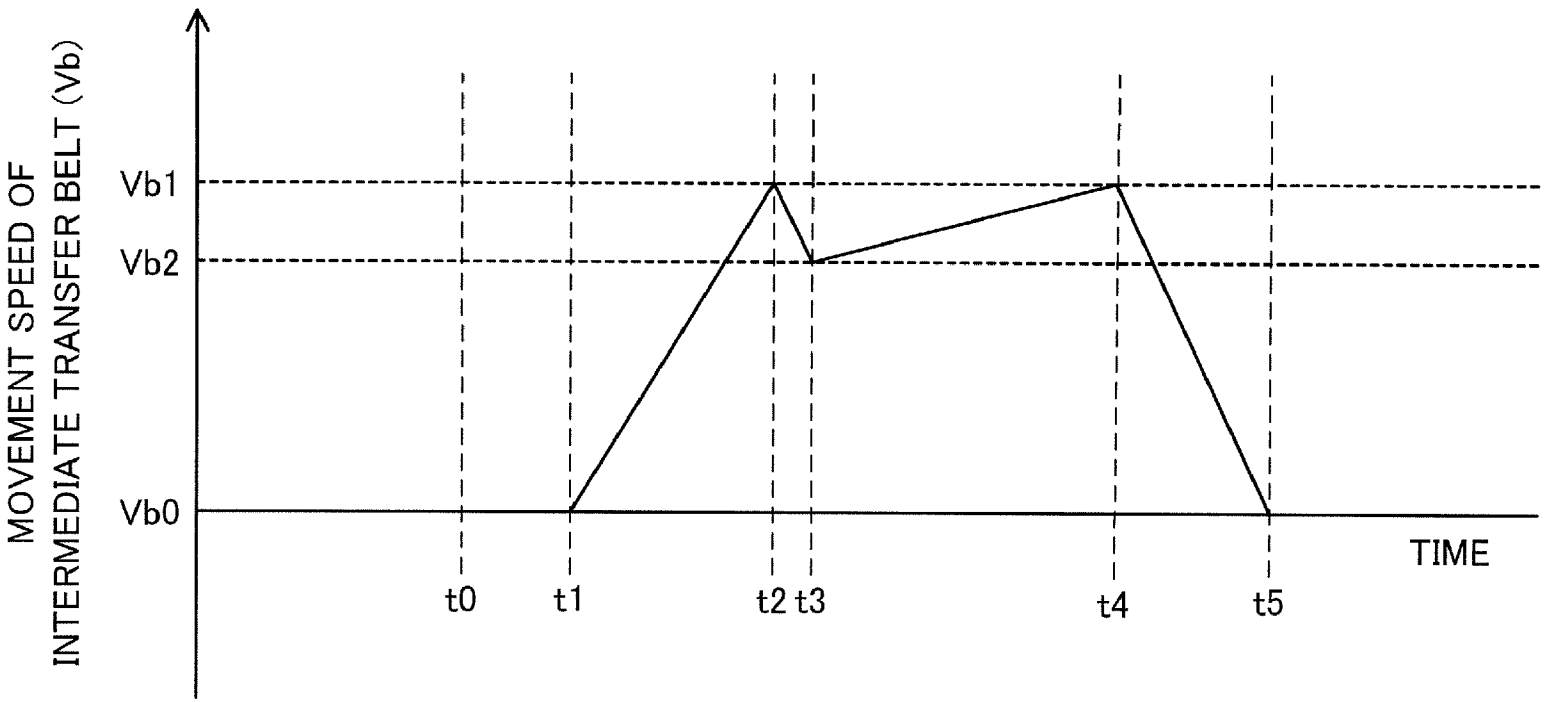
FIG. 7 shows the changes in the movement speed of the intermediate transfer belt.

The next drawing, FIG. 7, shows the changes in the movement speed Vb of the intermediate transfer belt 41. As shown in FIG. 7, the movement speed Vb of the intermediate transfer belt 41 is kept at the design value Vb0 from when the registration rolls 74 start transporting the paper sheet P (t0) to a time point t1 when the leading end portion of the paper sheet P enters the secondary transfer portion Tr2 (FIGS. 3A and 3B). From the time point t1 to a time point t2 when the leading end portion of the paper sheet P enters the fixing device 80 (FIGS. 4A and 4B), the push-in force applied by the paper sheet P that the registration rolls 74 transport at the transport speed Vr gradually increases the movement speed Vb of the intermediate transfer belt 41 from the design value Vb0 to the movement speed Vb1.

Then, from the time point t2 when the leading end portion of the paper sheet P enters the fixing device 80 (FIG. 4B) to a time point t3 when the paper sheet P gets slacked between the secondary transfer portion Tr2 and the fixing device 80 (FIG. 5A), the brake force applied by the paper sheet P decelerates the intermediate transfer belt 41, and thereby the movement speed Vb of the intermediate transfer belt 41 decreases to the movement speed Vb2 (≦Vb1). After the time point t3 when the paper sheet P gets slacked between the secondary transfer portion Tr2 and the fixing device 80 (FIG. 5A), the brake force that the paper sheet P applies on the intermediate transfer belt 41 decreases, and thus the intermediate transfer belt 41 is gradually accelerated again from the movement speed Vb2.

Then, before a time point t4 when the trailing end portion of the paper sheet P passes through the registration rolls 74 (FIG. 5B), the movement speed Vb of the intermediate transfer belt 41 reaches the movement speed Vb1 again.

Subsequently, after the time point t4 when the trailing end portion of the paper sheet P has just passed through the registration rolls 74 (FIG. 6A), the intermediate transfer belt 41 is freed from the push-in force applied by the paper sheet P that the registration rolls 74 transport at the transport speed Vr, and thus the paper sheet P applies the brake force on the intermediate transfer belt 41. Thereby, the intermediate transfer belt 41 is gradually decelerated from the movement speed Vb1, and, at a time point t5 after the time point t4, the movement speed Vb of the intermediate transfer belt 41 returns to the design value Vb0.

Then, after the time point t5 when the movement speed Vb of the intermediate transfer belt 41 returns to the design value Vb0, the trailing end portion of the paper sheet P passes through the secondary transfer portion Tr2 (FIG. 6B).

As described above, the movement speed Vb of the intermediate transfer belt 41 changes as shown in FIG. 7, for example. Thus, Y, M, C and K color toner images formed by the image forming units 30Y, 30M, 30C and 30K, respectively, are displaced on the intermediate transfer belt 41 when primarily transferred thereon. Specifically, such primary transfer displacements are generated in accordance with the changes in the movement speed Vb of the intermediate transfer belt 41 in a period from the time point t1 when the leading end portion of the paper sheet P enters the secondary transfer portion Tr2 to the time point t5 when the movement speed Vb of the intermediate transfer belt 41 returns to the design value Vb0.

On the other hand, since the image forming units 30 are placed on different positions along the intermediate transfer belt 41, the Y, M, C and K color toner images are formed at different timings. For example, it is assumed that the image forming units 30 are placed at regular intervals D. In this case, the image forming units 30 form and primarily transfer the color toner images for a single image region at timings delayed by D/Vb, respectively. In other words, how to primarily transfer different color toner images for a single image region may be described with reference to the image forming unit 30K as follows: the image forming unit 30Y primarily transfers the Y-color toner image a time 3D/Vb earlier than the image forming unit 30K; the image forming unit 30M primarily transfers the M-color toner image a time 2D/Vb earlier than the image forming unit 30K; and the image forming unit 30C primarily transfers the C-color toner image a time D/Vb earlier than the image forming unit 30K. Accordingly, in the period from the time point t1 when the leading end portion of the paper sheet P enters the secondary transfer portion Tr2 to the time point t5 when the movement speed Vb of the intermediate transfer belt 41 returns to the design value Vb0, the image forming units 30 form toner images for different image regions, respectively, and primarily transfer these toner images on the intermediate transfer belt 41. Hence, the color toner images for a single image region have mutually different primary transfer displacements in accordance with the changes in the movement speed Vb of the intermediate transfer belt 41. As a result, the obtained image includes a color shift.

Figure 8:
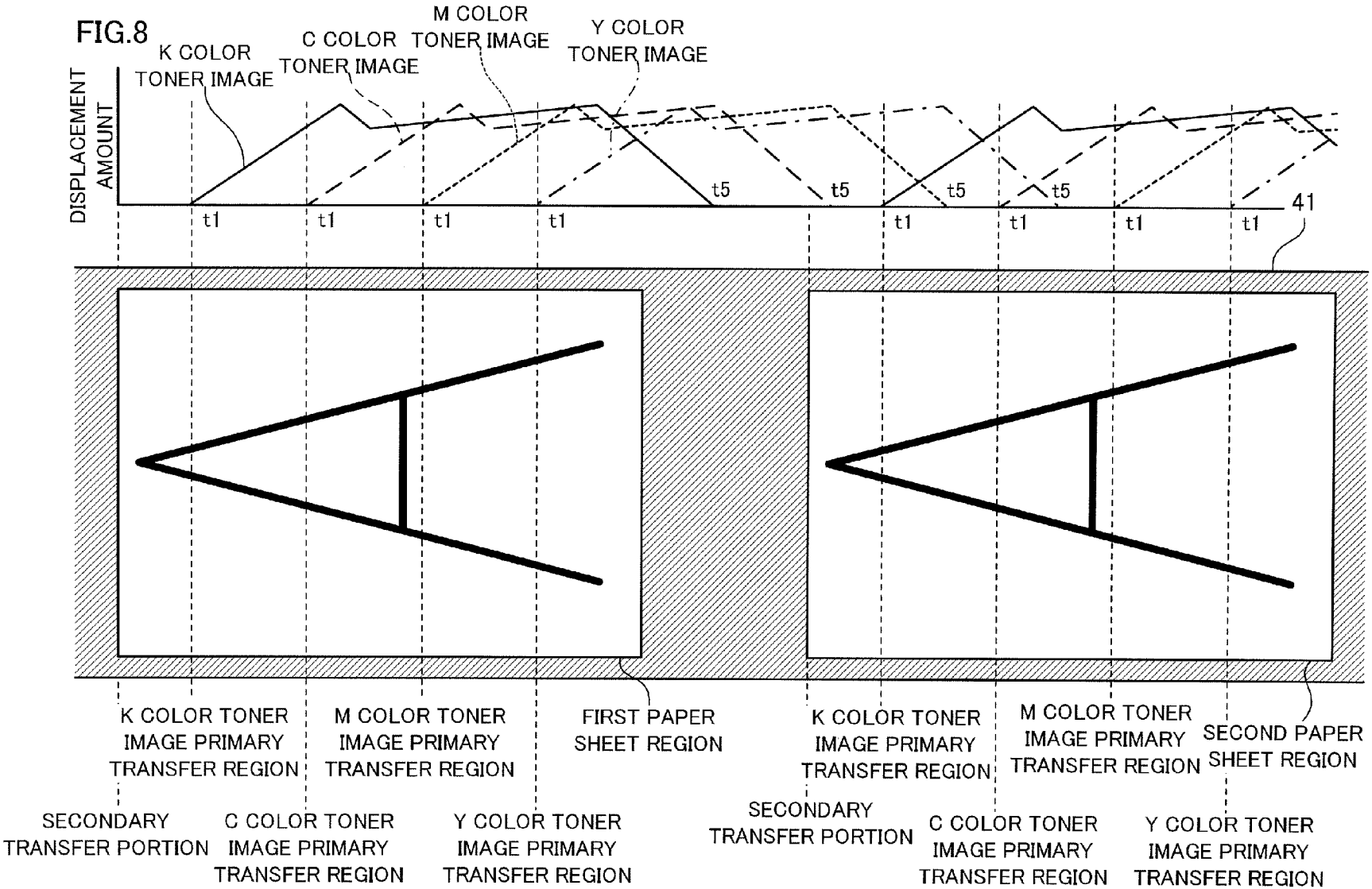
FIG. 8 illustrates how a color shift is generated in an image.

FIG. 8 illustrates how a color shift is generated in an image. FIG. 8 shows first and second paper sheet regions on the intermediate transfer belt 41, color toner image primary transfer regions and the secondary transfer portions Tr2. Here, each of the image forming units 30 primarily transfers the color toner image on the corresponding color toner image primary transfer region of the intermediate transfer belt 41, while the resultant images are secondarily transferred at a region of the intermediate transfer belt 41 corresponding to the secondary transfer portion Tr2. As shown in above-described FIG. 7, at the time point t1 when the leading end of the first paper sheet region enters the secondary transfer portion Tr2, the movement speed Vb of the intermediate transfer belt 41 starts changing. Thus, after the time point t1, the image forming unit 30K causes primary transfer displacements proportional to the changes in the movement speed Vb of the intermediate transfer belt 41, in the region downstream to the K-color toner image primary transfer region on the intermediate transfer belt 41. Similarly, the image forming units 30C, 30M and 30Y cause primary transfer displacements proportional to the changes in the movement speed Vb of the intermediate transfer belt 41, in the regions downstream to the C-color, M-color and Y-color toner image primary transfer regions on the intermediate transfer belt 41, respectively. Accordingly, as shown in FIG. 8, the color toner images have primary transfer displacements generated in accordance with distances between the layout positions of the image forming units 30 and in proportion to the change pattern in the movement speed Vb of the intermediate transfer belt 41. As a result, the color toner images for a single image region have mutually different primary transfer displacements, and thus the obtained image includes a color shift. The same holds true with second and subsequent paper sheet regions.

To address this problem, in the image forming apparatus 1 of the present exemplary embodiment, a circumferential speed Vm of the drive roll 49 that drives the intermediate transfer belt 41 is controlled so that the changes in the movement speed Vb of the intermediate transfer belt 41, as shown in FIG. 7, are reduced. Specifically, the controller 60, which is an example of a controller (control apparatus), in the present exemplary embodiment controls the rotation of the drive roll 49 that circulatingly moves the intermediate transfer belt 41 so that, for example, the changes in the movement speed Vb of the intermediate transfer belt 41 shown in FIG. 7 are canceled out.

Figure 9:
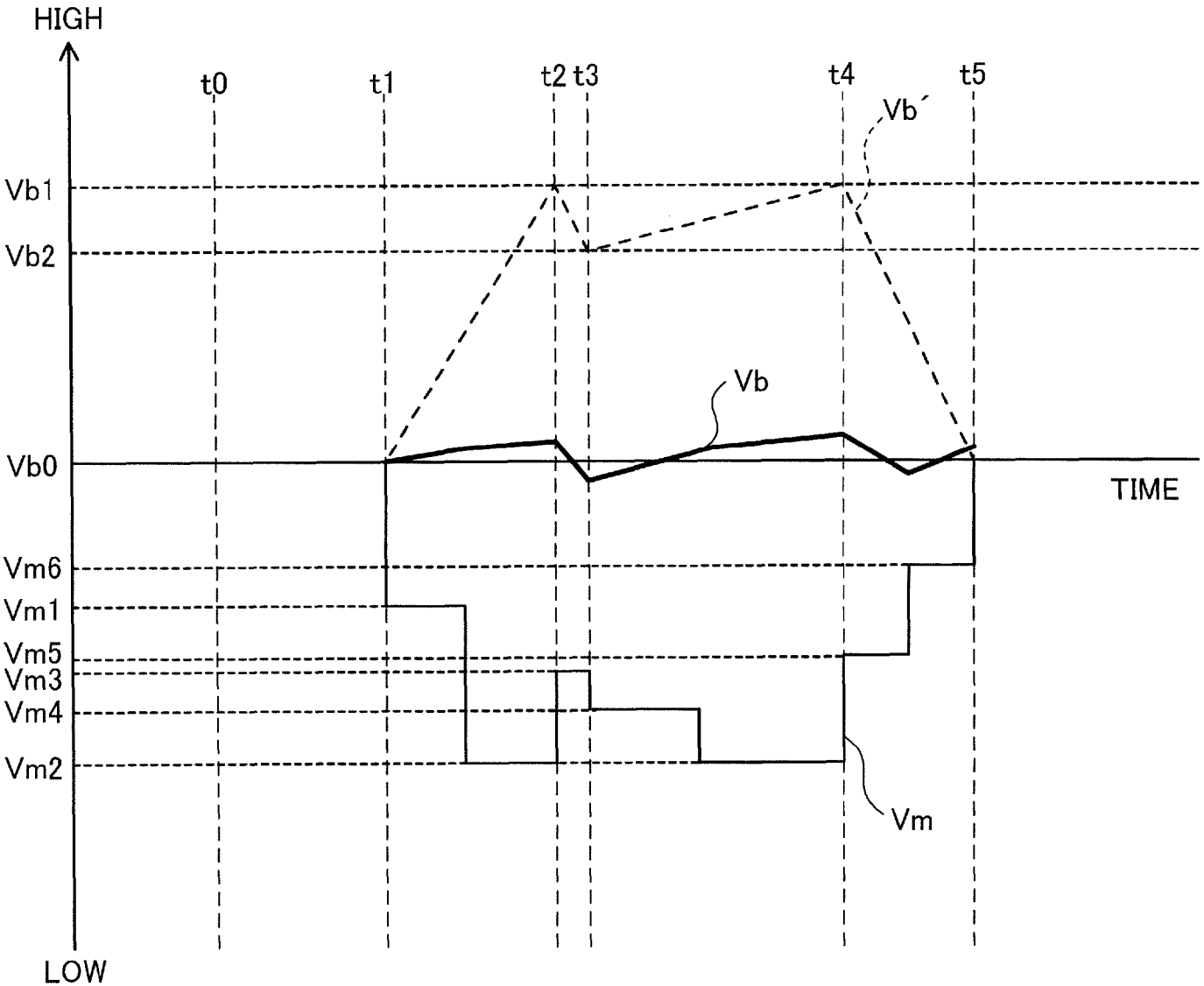
FIG. 9 shows a specific example of the circumferential speed at which the rotational control of the controller causes the drive roll to rotate.

FIG. 9 shows a specific example of the circumferential speed Vm at which the rotational control of the controller 60 causes the drive roll 49 to rotate. FIG. 9 shows a case where the circumferential speed Vm is controlled in accordance with the movement speed of the intermediate transfer belt 41 that changes as shown in FIG. 7 (hereinafter, this movement speed will be referred to as a changing movement speed Vb'). Here, since the circumferential speed Vm of the drive roll 49 is a movement speed on the rolling surface of the drive roll 49, the drive roll 49 rotating at the circumferential speed Vm circulatingly moves the intermediate transfer belt 41 at the movement speed Vm. Accordingly, the actual movement speed Vb of the intermediate transfer belt 41 is set to a value derived from both the changing movement speed Vb' and the circumferential speed Vm of the drive roll 49.

As described above, from the time point t1 when the leading end portion of the paper sheet P enters the secondary transfer portion Tr2 to the time point t2 when the leading end portion of the paper sheet P enters the fixing device 80, the changing movement speed Vb' of the intermediate transfer belt 41 is gradually increased from the design value Vb0 to the movement speed Vb1. Accordingly, from the time point t1 to the time point t2, the controller 60 sets the circumferential speed Vm of the drive roll 49 to one or more values lower than the design value Vb0. For example, the controller 60 reduces the circumferential speed Vm of the drive roll 49 in stages, that is, sets Vm to a circumferential speed Vm1 lower than the design value Vb0 at the time point t1, and then to a still lower circumferential speed Vm2 (<circumferential speed Vm1). Thereby, the drive roll 49 set to operate at the circumferential speed Vm1 or Vm2, which is lower than the design value Vb0, acts as a brake on the intermediate transfer belt 41 gradually accelerated from the design value Vb0, and thereby the changes in the movement speed of the intermediate transfer belt 41 are reduced. In this event, this brake effect is gradually exerted on the intermediate transfer belt 41 since the circumferential speed Vm of the drive roll 49 is changed in stages.

Note that the time point when the circumferential speed Vm of the drive roll 49 gets changed to a value lower than the design value Vb0 may be a time set in advance, before or after the time point t1 when the leading end portion of the paper sheet P enters the secondary transfer portion Tr2, as long as the changes in the movement speed of the intermediate transfer belt 41 are reduced.

Then, from the time point t2 when the leading end portion of the paper sheet P enters the fixing device 80 to the time point t3 when the paper sheet P gets slacked between the secondary transfer portion Tr2 and the fixing device 80, the brake force applied by the paper sheet P decelerates the intermediate transfer belt 41, and thereby the changing movement speed Vb1 of the intermediate transfer belt 41 decreases to the movement speed Vb2 (≦Vb1). Accordingly, from the time point t2 to the time point t3, the controller 60 sets the circumferential speed Vm of the drive roll 49 to a circumferential speed Vm3 higher than the circumferential speed Vm2. Thereby, the controller 60 reduces the brake effect exerted on the intermediate transfer belt 41 in response to the fact that the paper sheet P entering the fixing device 80 applies the brake force on the intermediate transfer belt 41.

Note that the time point when the circumferential speed Vm of the drive roll 49 gets changed to the circumferential speed Vm3 higher than the circumferential speed Vm2 may be a time set in advance, before or after the time point t2 when the leading end portion of the paper sheet P enters the fixing device 80, as long as the changes in the movement speed of the intermediate transfer belt 41 are reduced.

Then, from the time point t3 when the paper sheet P gets slacked between the secondary transfer portion Tr2 and the fixing device 80 to the time point t4 when the trailing end portion of the paper sheet P passes through the registration rolls 74, the intermediate transfer belt 41 is gradually accelerated again from the movement speed Vb2, and the changing movement speed Vb' of the intermediate transfer belt 41 reaches the movement speed Vb1 again. Accordingly, from the time point t3 to the time point t4, the controller 60 sets the circumferential speed Vm of the drive roll 49 to one or more values lower than the circumferential speed Vm3. For example, the controller 60 reduces the circumferential speed Vm of the drive roll 49 in stages, that is, sets Vm to a circumferential speed Vm4 lower than the circumferential speed Vm3 at the time point t3, and then to the still lower circumferential speed Vm2 (<circumferential speed Vm4). Thereby, the drive roll 49 set to operate at the circumferential speed Vm4 or Vm2, which is lower than the design value Vb0, acts as a brake on the gradually accelerated intermediate transfer belt 41, and thereby the changes in the movement speed of the intermediate transfer belt 41 are reduced. In this event as well, this brake effect is gradually exerted on the intermediate transfer belt 41 since the circumferential speed Vm of the drive roll 49 is changed in stages.

Note that the time point when the circumferential speed Vm of the drive roll 49 gets changed to a value lower than the circumferential speed Vm3 may be a time set in advance, before or after the time point t3 when the paper sheet P gets slacked between the secondary transfer portion Tr2 and the fixing device 80, as long as the changes in the movement speed of the intermediate transfer belt 41 are reduced.

Then, from the time point t4 when the trailing end portion of the paper sheet P has just passed through the registration rolls 74 to the time point t5, the intermediate transfer belt 41 is gradually decelerated from the movement speed Vb1, and then the movement speed Vb of the intermediate transfer belt 41 returns to the design value Vb0. Accordingly, from the time point t4 to the time point t5, the controller 60 sets the circumferential speed Vm of the drive roll 49 to one or more values higher than the circumferential speed Vm2. For example, the controller 60 increases the circumferential speed Vm of the drive roll 49 in stages, that is, sets Vm to a circumferential speed Vm5 higher than the circumferential speed Vm2 at the time point t4, and then to a still higher circumferential speed Vm6 (>circumferential speed Vm5). Thereby, the controller 60 reduces the brake effect exerted on the intermediate transfer belt 41 in response to the fact that the paper sheet P having passed through the registration rolls 74 applies the brake force on the intermediate transfer belt 41. In this event, this brake effect is gradually exerted on the intermediate transfer belt 41 since the circumferential speed Vm of the drive roll 49 is changed in stages.

Note that the time point when the circumferential speed Vm of the drive roll 49 gets changed to a value higher than the circumferential speed Vm3 may be a time set in advance, before or after the time point t4 when the trailing end portion of the paper sheet P has just passed through the registration rolls 74, as long as the changes in the movement speed of the intermediate transfer belt 41 are reduced.

Then, at time point t5, the circumferential speed Vm of the drive roll 49 is returned to the design value Vb0.

As described above, the movement speed Vb of the intermediate transfer belt 41 changes in accordance with the changes in a load imposed thereon while the intermediate transfer belt 41 is in contact with the paper sheet P on which the registration rolls 74 and the fixing device 80 apply transport forces. Thus, in accordance with the changes in the above load, the controller 60 controls the circumferential speed Vm of the drive roll 49 that circulatingly moves the intermediate transfer belt 41 so that the changes in the movement speed Vb of the intermediate transfer belt 41 are canceled out. This reduces the changes in the actual movement speed Vb of the intermediate transfer belt 41 from the design value Vb0, as shown in FIG. 9, and thus reduces a color shift in the obtained image.

As described above, in the specific example shown in FIG. 9, the controller 60 controls the circumferential speed Vm of the drive roll 49 so that the changes in the movement speed Vb of the intermediate transfer belt 41 are reduced, from the time point t1 when the leading end portion of the paper sheet P enters the secondary transfer portion Tr2 to the time point t5 after the time point t4 when the trailing end portion of the paper sheet P has just passed through the registration rolls 74.

Note that the time point t5 here is set to a time point before the trailing end portion of the paper sheet P passes through the secondary transfer portion Tr2, specifically.

However, to reduce the changes in the movement speed of the intermediate transfer belt 41 in accordance with the configuration of the image forming apparatus 1, the controller 60 may start changing the movement speed of the intermediate transfer belt 41 at either of: a time point when the leading end portion of the paper sheet P is passing through the secondary transfer portion Tr2 (on the secondary transfer roll 40); a time point in a time set in advance, after the leading end portion of the paper sheet P passes on the secondary transfer roll 40; and a time point when the leading end portion of the paper sheet P is located between the secondary transfer roll 40 and the registration rolls 74.

Similarly, the controller 60 may finish changing the movement speed of the intermediate transfer belt 41 as an example of a toner image carrying member at either of: a time point when the trailing end portion of the paper sheet P is located between the registration rolls 74 and the fixing device 80; a time point in a time set in advance, before the trailing end portion of the paper sheet P comes between the registration rolls 74; and a time point in a time set in advance, after the trailing end portion of the paper sheet P passes through the fixing device 80.

Incidentally, some image forming apparatuses each has a configuration in which transport rolls located upstream to the secondary transfer portion Tr2, such as the registration rolls 74, stop pressing a paper sheet P when the leading end of the paper sheet P enters the secondary transfer portion Tr2 (secondary transfer roll 40). In such an image forming apparatus, the movement speed of the intermediate transfer belt 41 may be changed at either a time point when these transport rolls stop pressing the paper sheet P or a time point in a time set in advance, before or after these transport rolls stop pressing the paper sheet P.

Figure 10:
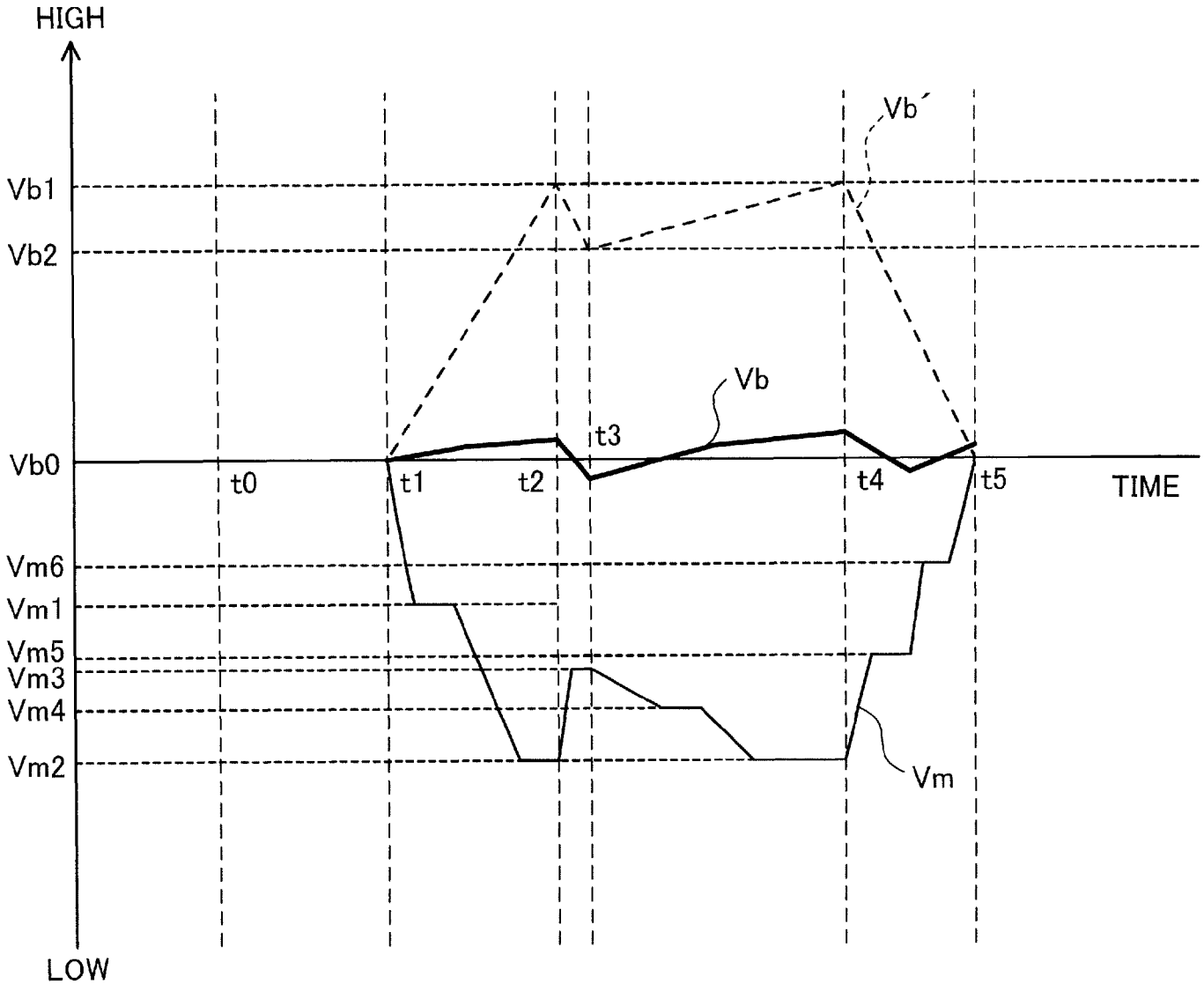
FIG. 10 shows another specific example of the circumferential speed at which the rotational control of the controller causes the drive roll to rotate.

FIG. 10 shows another specific example of the circumferential speed Vm at which the rotational control of the controller 60 causes the drive roll 49 to rotate. In the above example shown in FIG. 9, the brake effects are gradually exerted on the intermediate transfer belt 41 since the circumferential speed Vm of the drive roll 49 is changed in stages. By contrast, in the example shown in FIG. 10, the circumferential speed Vm of the drive roll 49 is continuously changed. This allows the drive roll 49 to exert brake effects more gradually on the intermediate transfer belt 41, and thus prevents image deterioration.

As described above, in the another specific example shown in FIG. 10, the controller 60 controls the circumferential speed Vm of the drive roll 49 so that the changes in the movement speed Vb of the intermediate transfer belt 41 are reduced, from the time point t1 when the leading end portion of the paper sheet P enters the secondary transfer portion Tr2 to the time point t5 after the time point t4 when the trailing end portion of the paper sheet P has just passed through the registration rolls 74. Note that the time point t5 here is set to a time point before the trailing end portion of the paper sheet P passes through the secondary transfer portion Tr2, specifically.

Figure 11:
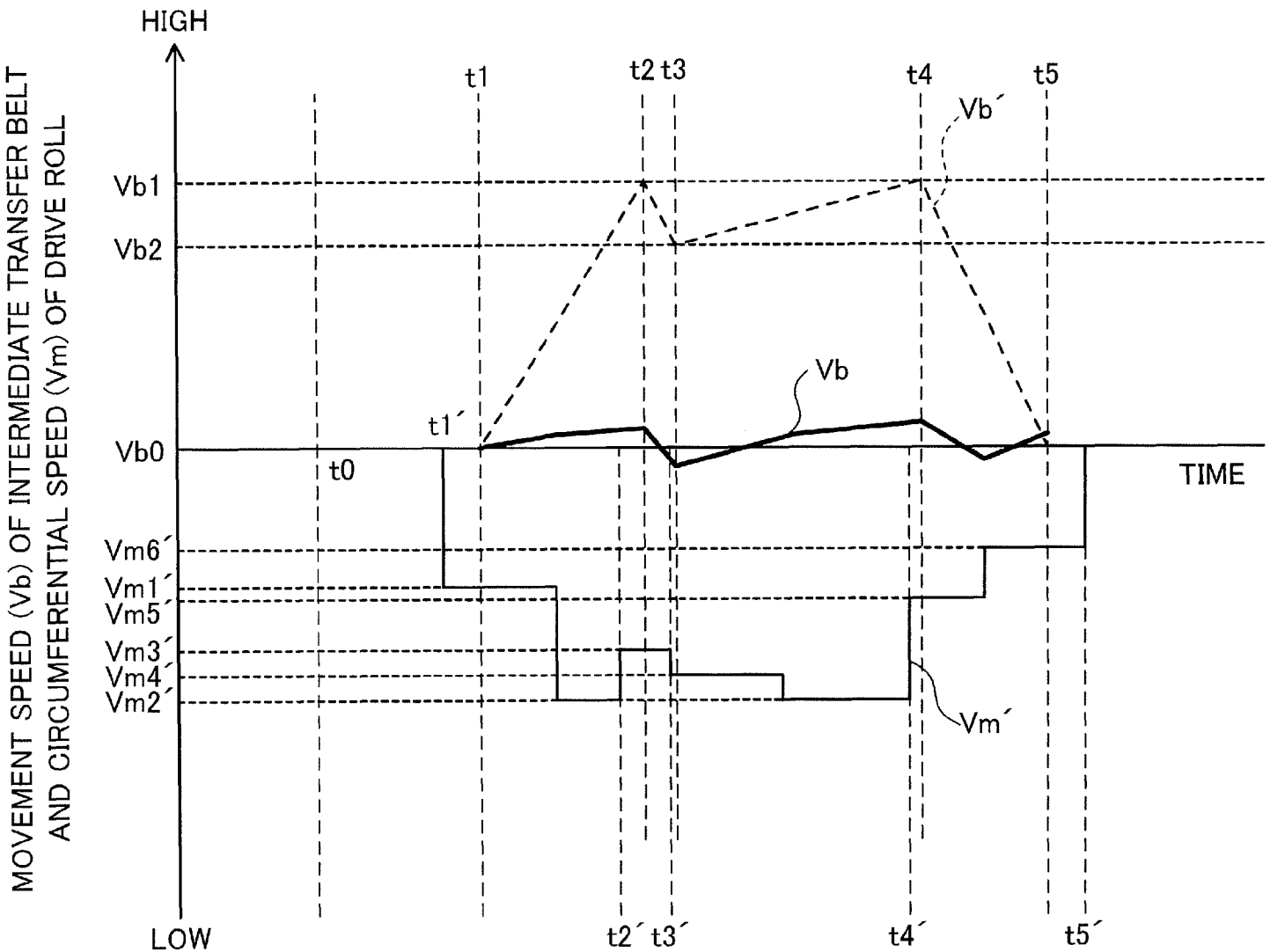
FIG. 11 shows still another specific example of the circumferential speed at which the rotational control of the controller causes the drive roll to rotate.

FIG. 11 shows still another specific example of the circumferential speed Vm at which the rotational control of the controller 60 causes the drive roll 49 to rotate. In the above example shown in FIG. 9, the controller 60 controls the circumferential speed Vm of the drive roll 49 in synchronization with the changes in the movement speed of the intermediate transfer belt 41. By contrast, in the example shown in FIG. 11, the controller 60 controls the circumferential speed Vm, of the drive roll 49 at time points t1' to t4' prior to the respective timings when the movement speed of the intermediate transfer belt 41 changes, and at a time point t5' after the movement speed of the intermediate transfer belt 41 changes. This allows the controller 60 to secure a longer time for adjusting the circumferential speed Vm' of the drive roll 49 in accordance with the changes in the movement speed of the intermediate transfer belt 41. Thereby, circumferential speeds Vm1' to Vm6' at which the drive roll 49 is set to operate are set closer to the design value Vb0 than Vm1 to Vm6 in the example shown in FIG. 9, respectively. This allows the drive roll 49 to exert brake effects more gradually on the intermediate transfer belt 41, and thus prevents image deterioration.

In the specific example shown in FIG. 11, the controller 60 controls the circumferential speed Vm of the drive roll 49 so that the changes in the movement speed Vb of the intermediate transfer belt 41 are reduced, in a period from the time point t1' before the time point t1 when the leading end portion of the paper sheet P enters the secondary transfer portion Tr2 to the time point t5' after the time point t5 when the movement speed Vb returns to the design value Vb0. Here, the time point t5 is after the time point t4 when the trailing end portion of the paper sheet P has just passed through the registration rolls 74. The time point t1' here is set to a time point between the time point t0 when the registration rolls 74 start transporting the paper sheet P and the time point t1 when the leading end portion of the paper sheet P enters the secondary transfer portion Tr2. Meanwhile, the time point t5' is set to a time point between the time point t4 when the trailing end portion of the paper sheet P has just passed through the registration rolls 74 and the time point when the trailing end portion of the paper sheet P passes through the secondary transfer portion Tr2.

Figure 12:
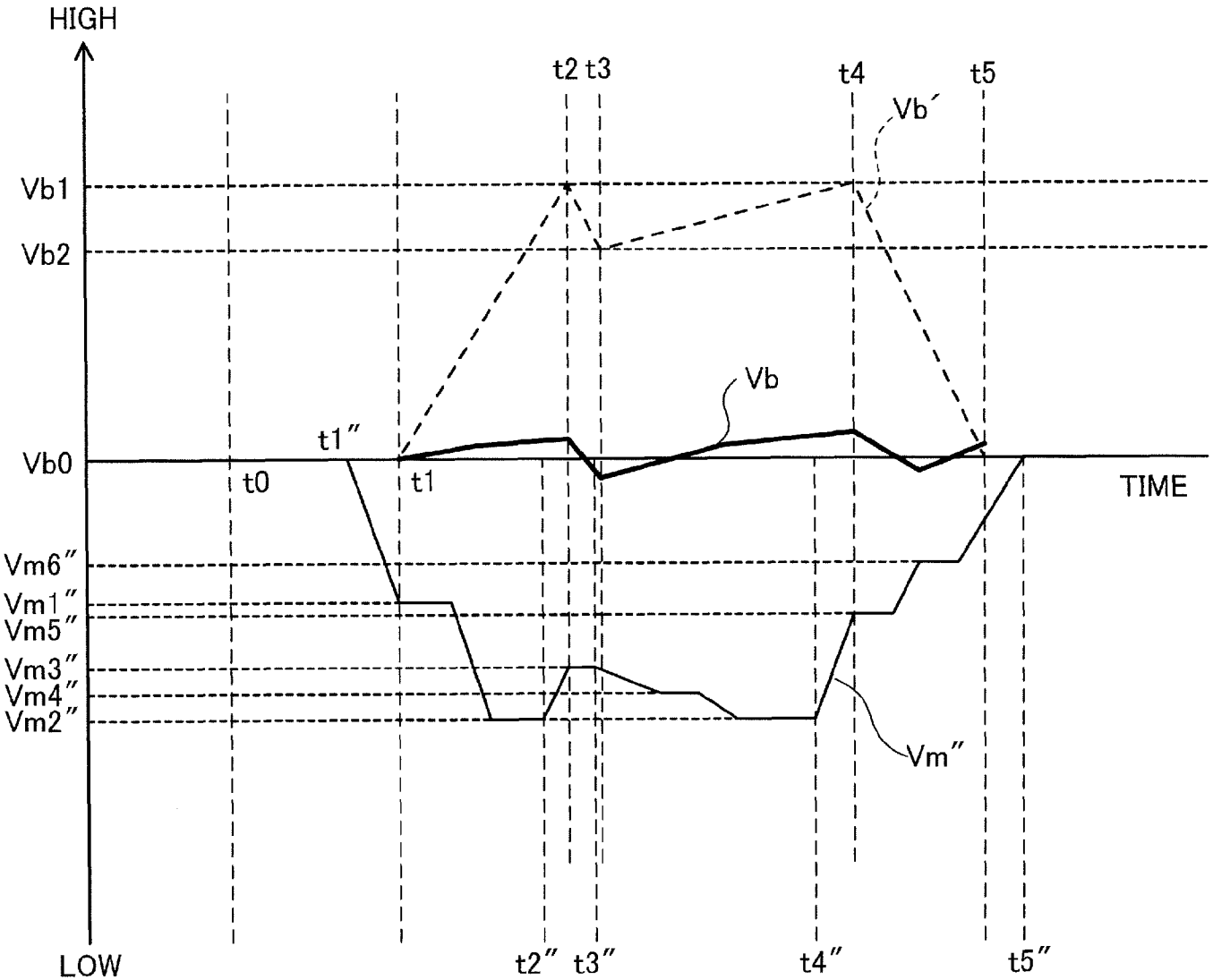
FIG. 12 shows a further specific example of the circumferential speed at which the rotational control of the controller causes the drive roll to rotate.

FIG. 12 shows a further specific example of the circumferential speed Vm at which the rotational control of the controller 60 causes the drive roll 49 to rotate. In the above example shown in FIG. 9, the controller 60 controls the circumferential speed Vm of the drive roll 49 in synchronization with the changes in the movement speed of the intermediate transfer belt 41. By contrast, in the example shown in FIG. 12, the controller 60 controls the circumferential speed Vm" of the drive roll 49 at time points t1" to t4" prior to the respective timings when the movement speed of the intermediate transfer belt 41 changes, and at a time point t5" after the movement speed of the intermediate transfer belt 41 changes. This allows the controller 60 to secure a longer time for adjusting the circumferential speed Vm" of the drive roll 49 in accordance with the changes in the movement speed of the intermediate transfer belt 41. Thereby, circumferential speeds Vm1" to Vm6" at which the drive roll 49 is set to operate are set closer to the design value Vb0 than Vm1 to Vm6 in the example shown in FIG. 9, respectively. In addition, the circumferential speed Vm" of the drive roll 49 is continuously changed. This allows the drive roll 49 to exert brake effects more gradually on the intermediate transfer belt 41, and thus prevents image deterioration.

In the specific example shown in FIG. 12, the controller 60 controls the circumferential speed Vm of the drive roll 49 so that the changes in the movement speed Vb of the intermediate transfer belt 41 are reduced, in a period from the time point t1" before the time point t1 when the leading end portion of the paper sheet P enters the secondary transfer portion Tr2 to the time point t5" after the time point t5 when the movement speed Vb returns to the design value Vb0. Here, the time point t5 is after the time point t4 when the trailing end portion of the paper sheet P has just passed through the registration rolls 74. The time point t1" here is set to a time point between the time point t0 when the registration rolls 74 start transporting the paper sheet P and the time point t1 when the leading end portion of the paper sheet P enters the secondary transfer portion Tr2. Meanwhile, the time point t5" is set to a time point between the time point t4 when the trailing end portion of the paper sheet P has just passed through the registration rolls 74 and the time point when the trailing end portion of the paper sheet P passes through the secondary transfer portion Tr2.

Next, a description will be given of the circumferential speed Vm at which the rotational control of the controller 60 causes the drive roll 49 to rotate, and for timings of setting the circumferential speed Vm.

As described above, the movement speed Vb of the intermediate transfer belt 41 changes by being increased and reduced repeatedly (refer to FIG. 7). Accordingly, the circumferential speed Vm of the drive roll 49 needs to be controlled in accordance with: the movement speed Vb1 that the intermediate transfer belt 41 reaches after being accelerated; the movement speed Vb2 that the intermediate transfer belt 41 reaches after being decelerated; a time period taken to reach the movement speed Vb1 (the periods between the time points t1 and t2, and between the time points t3 and t4 in FIG. 7, for example); a time period taken to reach the movement speed Vb2 (the period between the time points t2 and t3 in FIG. 7, for example); a time period taken to return to the design value Vb0 (the period between the time points t4 and t5 in FIG. 7, for example); and the like.

However, these "constituents of the change pattern of the movement speed Vb," such as the movement speeds Vb1 and Vb2, and the time periods taken to reach the respective movement speeds Vb1 and Vb2 vary depending on various changing factors. Thus, in the image forming apparatus 1 of the present exemplary embodiment, each of the values of these "constituents of the change pattern of the movement speed Vb" that vary depending on the various changing factors is calculated before the circumferential speed Vm of the drive roll 49 is controlled. In addition, values of the circumferential speed Vm of the drive roll 49 and timings (setting timing) of setting these respective values of the circumferential speed Vm are previously set so as to cancel out the changes in the movement speed of the intermediate transfer belt 41. Here, the changes are caused by the "constituents of the change pattern of the movement speed Vb" whose values vary depending on the various changing factors. The correspondence relations between the values of the circumferential speed Vm of the drive roll 49 and the setting timings for these respective values of the circumferential speed Vm are stored in a memory (a nonvolatile memory 104 in FIG. 13 to be described later) provided in the controller 60, in a table form. As shown in FIGS. 3 to 7, the setting timings for these values of the circumferential speed Vm of the drive roll 49 herein correspond to the positions of the paper sheet P on the transport path, respectively. In other words, such values of the circumferential speed Vm of the drive roll 49 that is to cancel out the changes in the movement speed of the intermediate transfer belt 41 are set corresponding to the positions of the paper sheet P on the transport path, respectively. This is because the load on the intermediate transfer belt 41 while the intermediate transfer belt 41 is in contact with the paper sheet P on which the registration rolls 74 and the fixing device 80 apply transport forces changes in accordance with the positions of the paper sheet P on the transport path. The correspondence relations between the values of the circumferential speed Vm of the drive roll 49 and the setting timings for these respective values of the circumferential speed Vm stored in the memory in a table form are defined for each combination of various changing factors.

The controller 60, functioning as an acquisition unit, acquires the table (correspondence relations) from the memory. In addition, the controller 60 determines the values of the circumferential speed Vm of the drive roll 49, and the setting timings for these values of the circumferential speed Vm (the positions of the paper sheet P on the transport path) by using the acquired table. Specifically, the controller 60 determines such values and timings that correspond to the "constituents of the change pattern of the movement speed Vb" (such as the movement speeds Vb1 and Vb2) whose values vary depending on the various changing factors, respectively. Then, the controller 60 controls the rotation of the drive roll 49 by using these determined values and timings. In other words, the controller 60 controls the rotation of the drive roll 49 by using the values of the circumferential speed Vm of the drive roll 49 and the setting timings for these respective values of the circumferential speed Vm determined corresponding to the various changing factors.

In this case, in response to (in synchronization with), for example, the timing (time point t0 in FIG. 7) when the registration rolls 74 start transporting the paper sheet P, the controller 60 starts the rotational control of the drive roll 49 according to the values of the circumferential speed Vm of the drive roll 49 and the setting timings for these respective values of the circumferential speed Vm obtained from the table. The controller 60 acquires or generates information (transport timing information) on the timing when the registration rolls 74 start transporting the paper sheet P. Note that, based on the transport timing information, the controller 60 may alternatively be set to start the rotational control of the drive roll 49 at a time point when the leading end portion of the paper sheet P is located between the registration rolls 74 and the secondary transfer portion Tr2. Then, the controller 60 stops the rotational control of the drive roll 49 at a time point (time point t5 in FIG. 7) after the trailing end portion of the paper sheet P has just passed through the registration rolls 74 (time point t4 in FIG. 7).

Note that, in the following description, the setting pattern (correspondence relations) of the circumferential speed Vm of the drive roll 49, as shown in FIGS. 9 to 12, for example, will be referred to as "control profile of the drive roll 49." Specifically, each control profile of the drive roll 49 consists of the values of the circumferential speed Vm of the drive roll 49 and the setting timings for these respective values of the circumferential speed Vm. Accordingly, the memory in the controller 60 stores therein a table in which control profiles of the drive roll 49 are respectively associated with combinations of the various changing factors.

Here, a description will be given of specific examples of changing factors to be associated with the control profile of the drive roll 49. The specific examples of changing factors include types of a paper sheet P. In other words, factors depending on the type of a paper sheet P, such as its materials, its basis weight, its hardness, presence or absence of surface coating thereon, and surface roughness of its front and back surfaces, affect the frictional force between the paper sheet P and the intermediate transfer belt 41. Thus, the values of the respective constituents of the changes in the movement speed Vb vary depending on the type of the paper sheet P of use. Hence, each control profile of the drive roll 49 is associated with a type of the paper sheet P.

Additionally, the specific examples of changing factors also include moisture contents of the paper sheet P. In other words, since rigidity ("stiffness") of the paper sheet P depends on the moisture contents of the paper sheet P, push-in and brake forces that the paper sheet P applies on the intermediate transfer belt 41 also depend on those moisture contents. Thus, the values of the respective constituents of the changes in the movement speed Vb vary depending on the moisture content of the paper sheet P of use. Hence, each control profile of the drive roll 49 is associated with temperature and humidity in the image forming apparatus 1, which are detected with the temperature sensor 67 and the humidity sensor 66, respectively (refer to FIG. 1).

Moreover, the specific examples of changing factors also include sizes of the paper sheet P on which an image is to be formed. The larger the paper sheet P is in the width direction, the stronger the frictional force between the paper sheet P and the intermediate transfer belt 41 is. Thus, the values of the respective constituents of the changes in the movement speed Vb vary depending on the size of the paper sheet P of use. Hence, each control profile of the drive roll 49 is associated with a size of the paper sheet P.

Incidentally, if a selected paper sheet P on which an image is to be formed has a smaller length in the transport direction, the image to be formed on the paper sheet P also has a smaller length in the movement direction of the intermediate transfer belt 41. In addition, the image forming apparatus 1 may be so large that the image forming unit 30K located at a most downstream portion of the intermediate transfer belt 41 completes the first-transfer of a K-color toner image for a paper sheet P before the time point t1 when the leading end of the paper sheet P enters the secondary transfer portion Tr2. Accordingly, if the above two conditions are simultaneously satisfied, there is no need to control the circumferential speed Vm of the drive roll 49 since the image formation for a paper sheet P is completed before the time point t1 when the leading end of the paper sheet P enters the secondary transfer portion Tr2. Thus, whether or not the length of the paper sheet P in the transport direction is smaller than a predefined value may be a criterion for judging whether or not to control the circumferential speed Vm of the drive roll 49. If the control of the movement speed of the intermediate transfer belt 41 (control of the circumferential speed Vm of the drive roll 49) is not performed depending on, for example, the changing factors such as the size of the paper sheet P, the processing load of the controller 60 is reduced.

Additionally, the specific examples of changing factors also include: whether the selected paper sheet P is any one of paper sheets P1 and P2 held in the respective paper sheet holding units 71A and 71B or a paper sheet P fed from the paper sheet holding unit 75 for manual feeding; and whether or not duplex printing is performed. Specifically, depending on which is selected from the paper sheet holding units 71A and 71B and the paper sheet holding unit 75 for manual feeding, and on whether or not duplex printing is performed, the paper sheet P is transported through either of the transport path R1, the duplex transport path R2 and the transport path R3 (refer to FIG. 1). Depending on the selected path, a slack amount of the paper sheet P formed between the registration rolls 74 and the secondary transfer portion Tr2, transport friction of the paper sheet P and the like vary, and consequently push-in and brake forces that the paper sheet P applies on the intermediate transfer belt 41 vary. Hence, each control profile of the drive roll 49 is associated with whether a selected paper sheet P is any one of paper sheets P1 and P2 held in the respective paper sheet holding units 71A and 71B or a paper sheet P fed from the paper sheet holding unit 75 for manual feeding; and whether or not duplex printing is performed.

The specific examples of changing factors include whether or not duplex printing is performed. During duplex printing, a toner image is formed on the back surface of a paper sheet P. Thus, at the secondary transfer portion Tr2, the frictional force between the paper sheet P and the drive roll 49 during duplex printing is smaller than during one-side printing. Moreover, the above reduced frictional force affects the frictional force between the paper sheet P and the intermediate transfer belt 41. Hence, each control profile of the drive roll 49 is associated with whether or not duplex printing is performed.

The specific examples of changing factors further include: the total number of paper sheets on which the image forming apparatus 1 forms images; a processing speed; and a loop amount of the paper sheet P between certain rolls located along the transport path of the paper sheet P. Hence, each control profile of the drive roll 49 is also associated with these factors.

To repeat the description above, in the image forming apparatus 1 of the present exemplary embodiment, the values of the respective "constituents of the change pattern of the movement speed Vb," such as the movement speeds Vb1 and Vb2, and the time period taken to reach the movement speed Vb1, are calculated for each combination of various changing factors as described above. Additionally, a control profile of the drive roll 49 is defined in accordance with the values of these respective constituent calculated for each combination. Specifically, t1 to t5 and Vm1 to Vm6 of FIG. 10, which shows an example of a control profile of the drive roll 49, may be set for each combination of the various changing factors. Alternatively, t1' to t5' and Vm1' to Vm6' of FIG. 11, which shows an example of a control profile of the drive roll 49, may be set for each combination. Still alternatively, t1" to t5" and Vm1" to Vm6" of FIG. 12, which shows an example of a control profile of the drive roll 49, may be set for each combination. The control profiles of the drive roll 49 are stored in the memory in the controller 60, in association with the respective combinations of the changing factors.

The controller 60 aggregates information on setting conditions and the like of the image forming apparatus 1, and, based on the information, selects one of the control profiles of the drive roll 49 from the table stored in the memory. Then, the controller 60 controls the drive roll 49 in accordance with the selected control profile of the drive roll 49.

Alternatively, the image forming apparatus 1 may be configured to allow the user to input a control profile of the drive roll 49 through an operation input unit (not shown in the figure) or an external terminal in order to set the control profile in accordance with setting conditions and the like of the image forming apparatus 1.

Note that, the image forming apparatus 1 of the present exemplary embodiment controls the movement speed Vb of the intermediate transfer belt 41, which is an example of a toner image carrying member for carrying toner images, so as to reduce the changes in the movement speed Vb of the intermediate transfer belt 41. However, the image forming apparatus 1 may alternatively have a configuration including a belt-like photoconductor so that color toner images are formed and superimposed on the photoconductor and that the superimposed toner images on the photoconductor is collectively transferred on a paper sheet P. In this case, the image forming apparatus 1 may control the movement speed of the belt-like photoconductor, which is an example of a toner image carrying member, so as to reduce the changes in the movement speed of the belt-like photoconductor.

Figure 13:
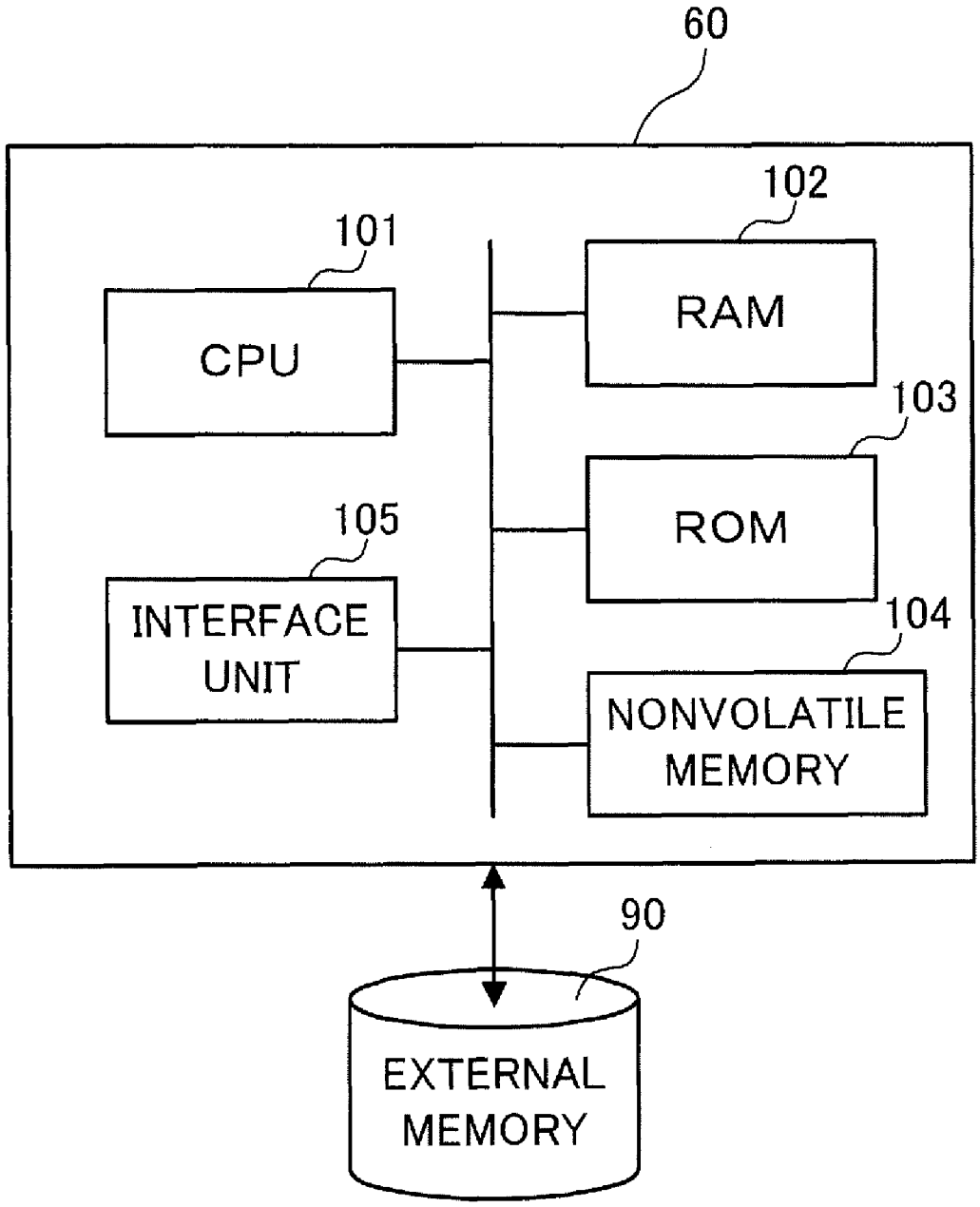
FIG. 13 shows a hardware configuration of the controller.

The next drawing, FIG. 13 shows a hardware configuration of the controller 60. As shown in FIG. 13, for controlling the circumferential speed Vm of the drive roll 49, the controller 60 is provided with: a CPU 101 as an example of a computing unit executing a digital computing processing in accordance with a program set in advance, a RAM 102 in which a program and the like executed by the CPU 101 are stored, a ROM 103 in which data such as setting values used for a program and the like executed by the CPU 101 are stored, a nonvolatile memory 104 such as an EEPROM, a flash memory or the like that is rewritable and that hold data without power supply, and an interface unit 105 that controls signal input to and signal output from respective units connected to the controller 60.

The table in which the above-mentioned various changing factors and the control profiles of the drive roll 49 are associated with each other is stored in the nonvolatile memory 104 as an example of a memory.

In the external memory 90, a program executed by the controller 60 is stored, the controller 60 reads out the processing program, and thus the control is executed in the controller 60. Specifically, a program or the like for executing control of the circumferential speed Vm of the drive roll 49 is read out from, for example, a hard disk, a DVD-ROM or the like, as the external memory 90, and loaded into the RAM 102 in the controller 60. Then, on the basis of the program loaded into the RAM 102, the CPU 101 performs various kinds of processings. As another aspect of providing the program, the program may be stored in the ROM 103 in advance, and be loaded into the RAM 102. Moreover, when a rewritable ROM 103 such as an EEPROM is provided, only the program may be installed in the ROM 103 and may be loaded into the RAM 102, after completion of setting the controller 60. In addition, the program may be transmitted to the controller 60 through a network such as the Internet, and then be installed in the ROM 103 in the controller 60 and loaded into RAM 102.

As described above, in the image forming apparatus 1 of the present exemplary embodiment, the controller 60 controls the circumferential speed Vm of the drive roll 49 that drives the intermediate transfer belt 41 so as to cancel out the changes in the movement speed Vb of the intermediate transfer belt 41. This reduces a color shift in the obtained image. Note that the above description is given for the image forming apparatus in which the intermediate transfer belt 41 is employed as an example of a toner image carrying member. However, as described above, the present invention may similarly be applied to what is termed as an image-on-image (IOI) type of an image forming apparatus, in which color toner images are sequentially superimposed and developed on a belt-like photoconductor or the like as an example of a toner image carrying member, and then collectively transferred on a paper sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a toner image carrying member that moves while carrying a toner image, the toner image being formed by each of a plurality of image forming units respectively forming color toner images;

a first transferring member that is arranged for each of the plurality of image forming units and that sequentially transfers, onto the toner image carrying member, the toner image formed by each of the plurality of image forming units;

a second transferring member that transfers, on a recording medium, the toner image that the toner image carrying member carries;

a transporting unit that transports the recording medium along a transport path that passes through a transfer region where the second transferring member transfers the toner image onto the recording medium;

a controller that controls a movement speed of the toner image carrying member; and a memory that stores a control profile, the control profile defining a relation between a position of the recording medium on the transport path and the movement speed of the toner image carrying member to be set according to the position of the recording medium, wherein the controller acquires the control profile from the memory and information on timing when the transporting unit starts transporting the recording medium, and in response to the acquired information, changes the movement speed of the toner image carrying member according to the control profile, thereby controlling and setting the movement speed of the toner image carrying member at the time of transfer by the first transferring member so as to cancel out changes in the movement speed of the toner image carrying member, the changes in the movement speed occurring according to a positional relationship between each of a leading end portion and a trailing end portion of the recording medium in the transporting unit, and a nip portion of the second transferring member.

2. The image forming apparatus according to claim 1, wherein the controller changes the movement speed of the toner image carrying member in stages or continuously so as to cancel out a change in the movement speed of the toner image carrying member, the change being generated when the toner image carrying member is in contact with the recording medium.

3. The image forming apparatus according to claim 1, wherein the transporting unit includes a first transporting member that is placed upstream to the second transferring member and that transports the recording medium to the second transferring member, and the controller starts changing the movement speed of the toner image carrying member at any one of:

a time point when a leading end portion of the recording medium is entering the nip portion of the second transferring member;

a time point in a time set in advance, after the leading end portion of the recording medium passes through the nip portion of the second transferring member; and a time point when the leading end portion of the recording medium is located between the second transferring member and the first transporting member.

4. The image forming apparatus according to claim 3, wherein, when at least a part of the recording medium is in the nip portion of the second transferring member, the controller changes the movement speed of the toner image carrying member at any one of:

a time point when a trailing end portion of the recording medium is passing through the first transporting member;

a time point in a time set in advance, before the trailing end portion of the recording medium enters the first transporting member; and a time point when the trailing end portion of the recording medium is located between the first transporting member and the second transferring member.

5. The image forming apparatus according to claim 3, wherein the transporting unit further includes a second transporting member that is placed downstream to the second transferring member and to which the recording medium is transported from the second transferring member, and when at least a part of the recording medium is in the nip portion of the second transferring member, the controller changes the movement speed of the toner image carrying member at any one of:

a time point when the leading end portion of the recording medium is passing through the second transporting member;

a time point in a time set in advance, after the leading end portion of the recording medium passes through the second transporting member; and a time point when the leading end portion of the recording medium is located between the second transporting member and the second transferring member.

6. The image forming apparatus according to claim 1, wherein the transporting unit includes:

a first transporting member that is placed upstream to the second transferring member and that transports the recording medium to the second transferring member; and a second transporting member that is placed downstream to the second transferring member and to which the recording medium is transported from the second transferring member, and the controller finishes changing the movement speed of the toner image carrying member at any one of:

a time point when a trailing end portion of the recording medium is located between the first transporting member and the second transporting member;

a time point in a time set in advance, before the trailing end portion of the recording medium enters the first transporting member; and a time point in a time set in advance, after the trailing end portion of the recording medium passes through the second transporting member.

7. The image forming apparatus according to claim 1, wherein the controller stores therein a correspondence relation between the position of the recording medium on the transport path and the movement speed of the toner image carrying member, in accordance with a factor for changing the movement speed of the toner image carrying member, and controls the movement speed of the toner image carrying member by using the correspondence relation that is stored.

8. The image forming apparatus according to claim 1, wherein the controller judges whether or not to change the movement speed of the toner image carrying member on the basis of a factor for changing the movement speed of the toner image carrying member.

9. A control apparatus, comprising:

an acquisition unit that acquires a control profile from a memory in which the control profile is stored, and information on timing when a transporting unit starts transporting a recording medium, the control profile defining a relation between a positional relation and a movement speed at which a toner image carrying member is set to move, the movement speed being set according to the positional relation, the positional relation being one between each of a leading end portion and a trailing end portion of the recording medium in a transport path, and a nip portion of the second transferring member, the toner image carrying member moving while carrying a toner image transferred by the first transferring member, the transport path passing through the nip portion of a second transferring member where the second transferring member transfers the toner image from the toner image carrying member onto the recording medium transported by the transporting unit; and a controller that changes the movement speed of the toner image carrying member according to the control profile and in response to the information acquired by the acquisition unit, thereby controlling and setting the movement speed of the toner image carrying member at the time of transfer by the first transferring member so as to cancel out changes in the movement speed of the toner image carrying member, the changes in the movement speed occurring according to the positional relation between each of a leading end portion and a trailing end portion of the recording medium in the transporting unit, and the nip portion of the second transferring member.

10. The control apparatus according to claim 9, wherein the controller changes the movement speed of the toner image carrying member in stages or continuously so as to cancel out a change in the movement speed of the toner image carrying member, the change being generated when the toner image carrying member is in contact or was just in contact with the recording medium.

11. The control apparatus according to claim 9, wherein the acquisition unit acquires the correspondence relation from the memory in which the correspondence relation is stored in association with a factor for changing the movement speed of the toner image carrying member; and the controller controls and sets the movement speed of the toner image carrying member by using the correspondence relation that is acquired.

12. A non-transitory computer readable medium including a program and a computer executable program code causing a computer to execute a process for controlling a movement speed of a toner image carrying member, the method comprising the steps of:

acquiring a control profile from a memory in which the control profile is stored, the control profile defining a relation between a positional relation and a movement speed at which the toner image carrying member is set to move, the movement speed being set according to the positional relation, the positional relation being one between each of a leading end portion and a trailing end portion of the recording medium in a transport path, and a nip portion of a second transferring member, the toner image carrying member moving while carrying a toner image transferred by a first transferring member, the transport path passing through the nip portion of the second transferring member where the second transferring member transfers the toner image from the toner image carrying member onto the recording medium transported by the transporting unit;

acquiring information on timing when a transporting unit starts transporting the recording medium; and changing the movement speed of the toner image carrying member according to the control profile and in response to the acquired information, thereby controlling and setting the movement speed of the toner image carrying member at the time of transfer by the first transferring member so as to cancel out changes in the movement speed of the toner image carrying member, the changes in the movement speed occurring according to the positional relation between each of a leading end portion and a trailing end portion of the recording medium in the transporting unit, and the nip portion of the second transferring member.

13. A control method, comprising:

acquiring a control profile from a memory in which the control profile is stored, the control profile defining a relation between a positional relation and a movement speed at which a toner image carrying member is set to move, the movement speed being set according to the positional relation, the positional relation being one between each of a leading end portion and a trailing end portion of the recording medium in a transport path, and a nip portion of a second transferring member, the toner image carrying member moving while carrying a toner image transferred by a first transferring member, the transport path passing through the nip portion of the second transferring member where the second transferring member transfers the toner image from the toner image carrying member onto the recording medium transported by the transporting unit;

acquiring information on timing when the transporting unit starts transporting the recording medium; and changing the movement speed of the toner image carrying member according to the control profile and in response to the acquired information, thereby controlling and setting the movement speed of the toner image carrying member at the time of transfer by the first transferring member so as to cancel out changes in the movement speed of the toner image carrying member, the changes in the movement speed occurring according to the positional relation between each of a leading end portion and a trailing end portion of the recording medium in the transporting unit, and the nip portion of the second transferring member.

* * * * *